US010584840B2

(12) United States Patent
Ashmore et al.

(10) Patent No.: US 10,584,840 B2
(45) Date of Patent: Mar. 10, 2020

(54) SOLAR POWERED COLLAPSIBLE LIGHT

(71) Applicants: James T Ashmore, Wimberley, TX (US); Nicholas J Ashmore, Wimberley, TX (US)

(72) Inventors: James T Ashmore, Wimberley, TX (US); Nicholas J Ashmore, Wimberley, TX (US)

(73) Assignee: Vision3 Design, Inc., Wimberly, TX (US)

( * ) Notice: Subject to any disclaimer, the term of this patent is extended or adjusted under 35 U.S.C. 154(b) by 363 days.

(21) Appl. No.: 15/400,873

(22) Filed: Jan. 6, 2017

(65) Prior Publication Data

US 2017/0198873 A1 Jul. 13, 2017

Related U.S. Application Data

(60) Provisional application No. 62/277,513, filed on Jan. 12, 2016.

(51) Int. Cl.
*F21S 9/03* (2006.01)
*F21V 1/06* (2006.01)
(Continued)

(52) U.S. Cl.
CPC ..... *F21S 9/037* (2013.01); *F21V 1/06* (2013.01); *F21V 1/26* (2013.01); *F21V 15/01* (2013.01);
(Continued)

(58) Field of Classification Search
CPC . F21V 29/70; F21V 29/83; F21V 1/26; F21V 15/01; F21V 21/406; F21V 23/003;
(Continued)

(56) References Cited

U.S. PATENT DOCUMENTS 3,222,512 A * 12/1965 Dickson ..... F21S 43/19 362/540
3,787,675 A * 1/1974 Rushing ..... F21L 4/00 340/321
(Continued)

OTHER PUBLICATIONS

Webpage entitled "PSL—Personal Solar Light SLE—Solar Lighting Element", available at http://702solarworks.com/ (702 Solar Works, Inc) Dec. 31, 2015 (Dec. 31, 2015), entire website, 5 pages.
(Continued)

*Primary Examiner* — Alan B Cariaso
(74) *Attorney, Agent, or Firm* — RM Reed Law PLLC

(57) ABSTRACT

In some embodiments, an apparatus may include a collapsible shade formed from a semitransparent material and a housing. The housing may have a substantially cylindrical shape including a first end and a second end, and the collapsible shade may be coupled to a first end of the housing. The housing may include a light-emitting diode (LED) circuit including an LED coupled to the second end of the housing. Further, a user-selectable button may be coupled to the housing. The apparatus may also include a control circuit within the housing and coupled to the user-selectable button and to the LED circuit. The control circuit may be configured to control the LED to emit light having a selected wavelength and a selected brightness in response to selection of the user-selectable button.

18 Claims, 18 Drawing Sheets

(51) Int. Cl.

| | |
|---|---|
| ***F21V 15/01*** | (2006.01) |
| ***F21V 15/04*** | (2006.01) |
| ***F21V 21/40*** | (2006.01) |
| ***F21V 29/70*** | (2015.01) |
| ***F21V 31/03*** | (2006.01) |
| ***F21V 1/26*** | (2006.01) |
| ***F21V 23/00*** | (2015.01) |
| ***F21V 23/04*** | (2006.01) |
| ***H05B 33/08*** | (2020.01) |
| *F21Y 115/15* | (2016.01) |

(52) U.S. Cl.
CPC ..... *F21V 15/04* (2013.01); *F21V 21/406* (2013.01); *F21V 23/003* (2013.01); *F21V 23/0407* (2013.01); *F21V 29/70* (2015.01); *F21V 31/03* (2013.01); *H05B 33/0845* (2013.01); *H05B 33/0863* (2013.01); *F21Y 2115/15* (2016.08)

(58) Field of Classification Search
CPC ..... F21V 23/0407; F21V 1/06; F21V 31/00; F21V 31/005; F21V 31/03; F21V 15/04; F21S 9/037
USPC ..... 340/321, 331
See application file for complete search history.

(56) References Cited

U.S. PATENT DOCUMENTS 4,697,228 A * 9/1987 Mui ..... F21L 4/02 362/208
4,782,432 A * 11/1988 Coffman ..... F21L 4/025 136/291
5,349,506 A * 9/1994 Maglica ..... F21L 4/005 362/158
6,095,661 A 8/2000 Lebens et al.
6,874,905 B1 * 4/2005 Beadle ..... F21S 8/081 362/141
7,264,380 B1 4/2007 Monroe et al.
9,080,736 B1 * 7/2015 Salzinger ..... H05B 37/0218
2006/0087851 A1 4/2006 Dubord
2007/0091594 A1 4/2007 Soon
2007/0153512 A1 * 7/2007 Hendrie ..... F21L 4/027 362/231
2007/0171082 A1 * 7/2007 Melnik ..... F21L 4/005 340/574
2007/0297167 A1 * 12/2007 Greenhoe ..... F21S 9/032 362/183
2009/0175034 A1 7/2009 Allsop et al.
2011/0121727 A1 * 5/2011 Sharrah ..... F21L 4/00 315/32
2012/0007486 A1 * 1/2012 Mora ..... F21V 29/70 313/46
2012/0188745 A1 7/2012 Yoneda
2012/0188752 A1 * 7/2012 Chen ..... F21S 8/085 362/183
2014/0055988 A1 2/2014 Cohen
2014/0240967 A1 * 8/2014 Sharrah ..... F21L 4/08 362/183
2015/0176782 A1 6/2015 McLennan et al.

OTHER PUBLICATIONS

Webpage entitled "Personal Solar Light", available at https://www.facebook.com/personalsolarlight (Personal Solar Light), retrieved on Mar. 15, 2017, posts from Mar. 4, 2016 to Dec. 27, 2016, 32 pages.
Webpage entitled "The PSL Light—Personal Solar Light", available at http://socialcoadvertising.com/personalsolarlight/features/ (personal Solar Light), retrieved on Mar. 15, 2017, entire website, 5 pages.
PCT/US17/12624, "Solar Powered Collapsible Light", Search Report and Written Opinion, dated Apr. 5, 2017, 13 pages.

* cited by examiner

SOLAR POWERED COLLAPSIBLE LIGHT

CROSS-REFERENCE TO RELATED APPLICATION(S)

The present disclosure is a non-provisional of and claims priority to U.S. Provisional Patent Application No. 62/277,513 filed on Jan. 12, 2016 and entitled "Solar-Powered Collapsible Light", which is incorporated herein by reference in its entirety.

FIELD

The present disclosure is generally related to portable, solar-powered lights, and more particularly to solar-powered lights including a collapsible structure.

BACKGROUND

Solar lights are commonly used to illuminate walkways and paths. Additionally, solar lamps are commercially available that can be used as hanging lanterns, which may be similar to Asian hanging lanterns.

Recently, some solar-powered lanterns have been developed that can be used in outdoor settings, such as campgrounds. However, such devices are typically manufactured to be aesthetically pleasing, but may not be designed to survive rugged outdoor use.

SUMMARY

In some embodiments, an apparatus may include a collapsible shade formed from a semitransparent material and a housing. The housing may have a substantially cylindrical shape including a first end and a second end, and the collapsible shade may be coupled to a first end of the housing. The housing may include a light-emitting diode (LED) circuit including an LED coupled to the second end of the housing. Further, a user-selectable button may be coupled to the housing. The apparatus may also include a control circuit within the housing and coupled to the user-selectable button and to the LED circuit. The control circuit may be configured to control the LED to emit light having a selected wavelength and a selected brightness in response to selection of the user-selectable button.

In other embodiments, an apparatus may include a housing including a first end and at least one sidewall extending substantially perpendicular to the first end to provide an open second end. The sidewall and the first end may cooperate to define an enclosure. Further, the sidewall may include at least one opening adjacent to the open second end. The apparatus may further include a housing cover configured to fit the open second end to seal the enclosure below a level of the at least one opening. The apparatus may also include a button coupled to the housing and accessible to a user. Further, the apparatus can include a heat sink coupled to the housing cover adjacent to the at least one opening and configured to allow air flow between the heat sink and the housing cover. A light-emitting diode (LED) circuit may be coupled to the heat sink and configured to emit light in response to a control signal. The apparatus can also include a control circuit within the enclosure and coupled to the user-selectable button and to the LED circuit. The control circuit may be configured to provide the control signal to the LED.

In still other embodiments, an apparatus can include a housing defining an enclosure, a solar panel coupled to a first end of the housing, and a light emitting diode (LED) circuit coupled to a second end of the housing. The LED circuit can include a multi-color LED. The apparatus may further include a collapsible shade including a first open end configured to couple to the second end of the housing around the LED circuit and including a second open end. The apparatus may also include a button coupled to the housing and a control circuit within the enclosure and coupled to the button. The control circuit may be configured to selectively provide a control signal to the LED circuit in response to a button press event to control the LED to emit light according to selected brightness level of a plurality of brightness levels, according to a selected wavelength from a plurality of wavelengths, and according to a Morse code.

BRIEF DESCRIPTION OF THE DRAWINGS

Drawings are provided herewith for illustrative purposes only, and are not intended to be limiting with respect to the scope of the present disclosure.

In the following discussion, the same reference numbers are used in the various embodiments to indicate the same or similar elements.

DETAILED DESCRIPTION OF ILLUSTRATIVE EMBODIMENTS

Embodiments of a solar-powered collapsible light are described below that can include a controllable light source and a shade that can be collapsed or expanded. In some embodiments, the solar-powered collapsible light may include a button accessible by a user and configured to control operation of the light source. In some embodiments, the user may depress the button to turn the light source on, to change the color of light emitted by the light source, to activate a selected illumination pattern (such as an S-O-S pattern, a changing color pattern, another pattern, or any combination thereof).

In some embodiments, a solar-powered collapsible light may include a housing coupled to a collapsible shade. The housing may include a photo-voltaic cell, a battery, a button, a light source, and a circuit coupled to the light source and to the button. In some embodiments, the housing may include a sealed portion configured to secure the battery and the circuit, an unsealed portion including the light source, and a heat sink coupled between the light source and the unsealed portion. The housing may be configured to allow air flow on both sides of the light source to facilitate cooling of the light source.

In some embodiments, gaskets may be provided within the housing and between components, which gaskets may serve a dual function: sealing the housing from the environment and providing cushioning from impact events. In a particular example, the solar-powered collapsible light may be impact resistant and waterproof. One possible example of a solar-powered collapsible light is described below with respect to FIG. 1.

Figure 1:
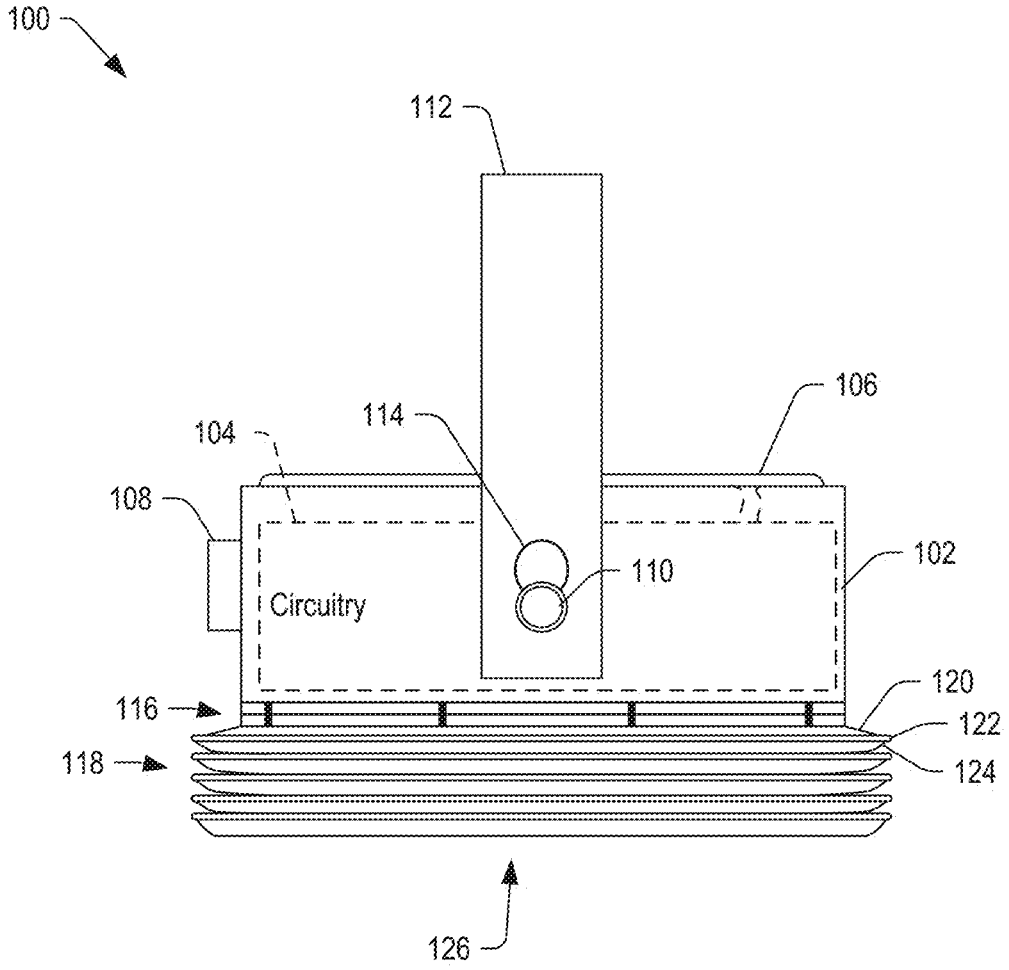
FIG. 1 depicts a side view of a solar-powered collapsible light including a shade in a collapsed state, in accordance with certain embodiments of the present disclosure.

FIG. 1 depicts a side view of a solar-powered collapsible light (generally indicated at 100) including a shade in a collapsed state, in accordance with certain embodiments of the present disclosure. The solar-powered collapsible light 100 may include a housing 102 defining an enclosure configured to secure circuitry 104, such as control circuitry, power management circuitry, a memory, a battery, and other circuits (such as a light emitting circuit). The housing 102 may include a solar panel (or photovoltaic cell) 106, which may configure light into electricity. The housing 102 may further include a button 108, which may be partially encased in an extension of the housing 102. Further, the housing 102 may include a post or hook 110, which may be configured to selectively engage an opening 114 in a handle 112, allowing the handle 112 to be detached. In some embodiments, the housing 102 may further include openings 116 to allow for air flow through the housing and across both sides of a heat sink.

Figure 2:
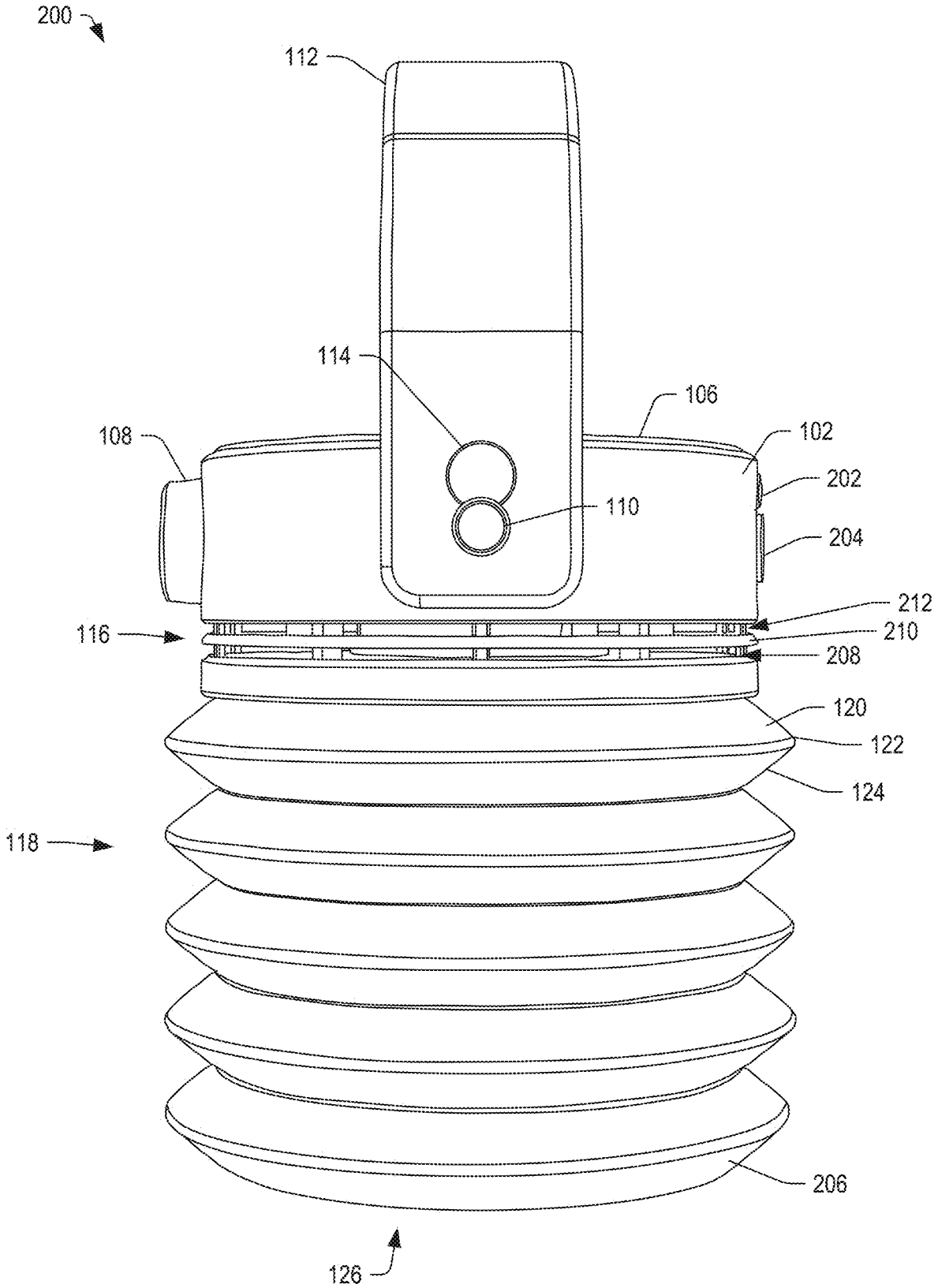
FIG. 2 depicts a side view of the solar-powered collapsible light of FIG. 1 and including a shade in an expanded state, in accordance with certain embodiments of the present disclosure.

The housing 102 may also be coupled to a collapsible shade 118 having a substantially, cylindrical profile and having an open bottom portion. The collapsible shade 118 may formed from a plurality of pleats, each including a first portion 120, a second portion 124, and a reinforced portion 122 coupling the first and second portions 120 and 124. In certain embodiments, shade 118 may be formed from a material, such as a plastic material, and the reinforced portion 122 may be formed from a thicker region of the same material The pleats allow the collapsible shade 118 to be fully collapsed (as shown), fully extended (as depicted in FIG. 2), or partially extended and to retain its state. Further, the collapsible shade 118 may allow light to pass through and may serve as a diffuser to distribute light provided by a light source coupled to a bottom of the housing 102. The shade 118 may include an open end (generally indicated at 126).

In some embodiments, the housing 102 may include a cylindrical cap formed from plastic, aluminum, paper, another material, or any combination thereof. In a particular embodiment, the housing 102 may be formed from a weather-resistant plastic, such as polycarbonate, polypropylene, or polyvinylchloride. The shade 118 can be fabricated from a material that allows the partial or complete transmission of light through the material. Further, the shade 118 can be made in a variety of sizes. In some embodiments, the shade 118 may optionally be coated, printed with, or otherwise labeled to provide a customized shade. For example, the shade 118 may include a logo associated with a sports team, a business, a movie character, an image, or another optical feature. In certain embodiments, the shade 118 may be formed from a material, such as paper (e.g., variable thickness cardstock), nylon, fabric, plastic, or other materials. In a particular example, the shade 118 may be formed from high-density polyethylene (HDPE) or polyethylene high-density (PEHD), nylon, polyvinylchloride, polypropylene, another material, or any combination thereof.

In some embodiments, the solar panel 106 be formed from one or more photovoltaic cells and may be configured to generate sufficient electricity to recharge a rechargeable battery within the housing 102. Further, the housing 102 may include a recharge port to enable recharging using a Universal Serial Bus (USB)-type of connector (e.g., a USB micro port) to provide a supplemental charge source when available light is insufficient to recharge the battery. In some embodiments, the housing 102 may also include an indicator light configured to emit light in response to receiving electricity from the supplemental charge source via the recharge port.

In some embodiments, the switch 108 may be coupled to a controller within the housing 102 to control operation of a light source coupled to the bottom of the housing 102 and surrounded by the shade 118. The switch 108 may be used to access multiple functions, which control the light source to turn on, turn off, flash periodically, flash according to a pattern, change colors, or any combination thereof.

In a particular embodiment, the button 108 may be pressed and released once to activate the light source to provide a substantially white light at a "high" or "bright" light level. The button 108 may be pressed and released a second time to adjust the brightness from the "high" level to a "medium" level, may be pressed and released a third time to adjust the brightness from the "medium" level to a "low" level, and may be pressed and released a fourth time to turn off the light. In this particular embodiment, pressing and holding the button 108 in a depressed position for a period of time (such as two seconds) activates the light source to flash on and off according to a pre-determined pattern, such as a Morse code distress signal pattern (i.e., an S-O-S pattern) or another pattern. In some embodiments, the light source may be a multi-color light-emitting diode (LED), and the button 108 may also be used to change the color of light emitted by the light source. In an example, pressing the button 108 twice in rapid succession (or holding the button 108 in a depressed state for a second period of time that is less than the period of time used to access the pre-determined pattern) may cause a controller within the housing 102 to drive the light source at a different frequency, causing the light source to emit light of a different wavelength. The controller may be configured to drive a pre-determined number of frequency ranges, enabling a pre-determined number of colors. In a particular embodiment, the solar-powered collapsible light 100 may be configured to emit a white/yellow light, a blue light, a green light, a red light, and an ultraviolet light.

FIG. 2 depicts a side view 200 of the solar-powered collapsible light of FIG. 1 and including a shade 118 in an expanded state, in accordance with certain embodiments of the present disclosure. In the illustrated view 200, the housing 102 may include an indicator light 202 and a recharge port 204. The recharge port 204 may be closed with a gasket or other type of cover, which can be configured to fit within the opening of the recharge port 204 to seal the recharge port 204 from the outside environment and to open to allow access to the port. The recharge port 204 may be a USB micro port configured to mate with a connector to receive electrical current through a USB cable. During a recharge operation, the indicator light 202 may be activated to emit light to show that the recharge port 204 is receiving power, to show a status of the recharge option (e.g., red while recharging and green when the recharge operation is complete), and so on. Other embodiments are also possible.

In the view 200, the shade 118 is extended or expanded from its fully collapsed state depicted in FIG. 1 to its fully expanded state. The shade 118 includes an open end (generally indicated at 126). A bottom pleat 206 of the collapsible shade 118 may be sufficiently rigid to serve as a base to support the housing 102 and the rest of the shade 118, such that the light 100 may rest on its shade 118 in either an expanded or a collapsed state.

Further, in the view 200, the housing 102 includes the openings 116. The openings 116 include a first opening 208, which may be external to a sealed portion of the housing 102 and which may be on a first side of a heat sink coupled to the light source. The openings 116 may further include a second opening 212, which may be external to the sealed portion of the housing 102 and which may be on a second side of the heat sink. A separating element 210 may separate the first and second openings and may be aligned with the heat sink. By providing a heat sink external to the sealed enclosure of the housing 102 and by allowing for air flow on both sides of the heat sink, heat generated by the light source itself and heat generated by switching of currents within the circuitry of the light source may be dissipated efficiently. In conventional systems that do not provide for ambient cooling of the light source and its circuitry, the light-emitting circuit may fail over time due to overheating of the circuit. In contrast, the openings 116 of the light 102 provide for cooling of the circuit associated with the light-source, extending the usable life of the circuit by reducing the heating effect of operation. Further, by sealing the housing 102 separately, the heat sink may be cooled by air flow (or fluid flow) from the surrounding environment without exposing the control circuitry or the rechargeable battery to the environment.

Figure 3:
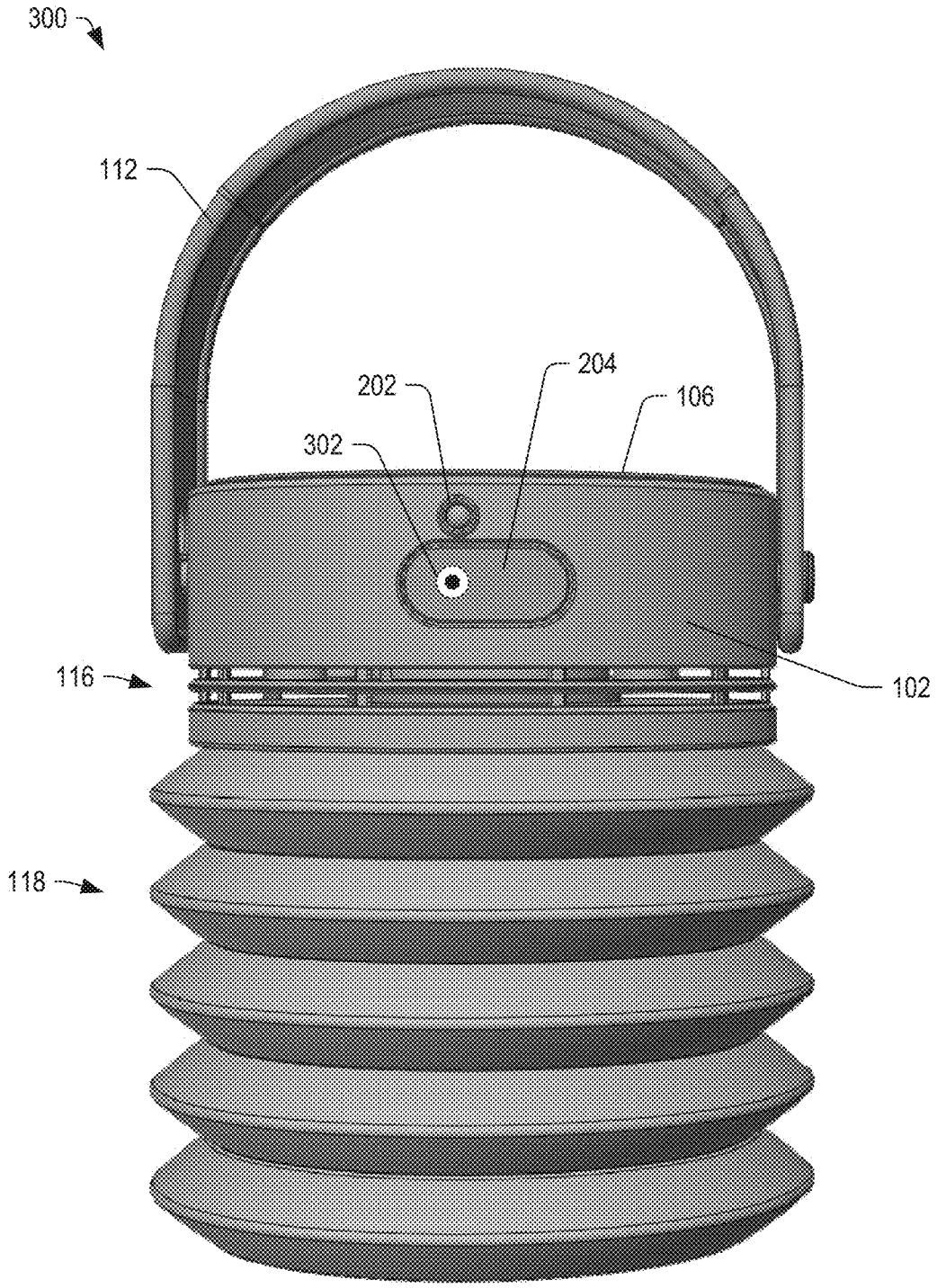
FIG. 3 depicts a rear perspective view of the solar-powered collapsible light of FIGS. 1 and 2 and illustrating an indicator light and a recharge port, in accordance with certain embodiments of the present disclosure.

FIG. 3 depicts a rear perspective view 300 of the solar-powered collapsible light of FIGS. 1 and 2 and illustrating the indicator light 202 and the recharge port 204, in accordance with certain embodiments of the present disclosure. It should be appreciated that the recharge port 204 indicated in the view 300 (and in the view 200 of FIG. 2) is sealed by a gasket, which is configured to seal the enclosure that includes the recharge port. In the view 300, the recharge port 204 includes an opening 302 configured to receive the micro USB connector to receive a supplemental charge for recharging the rechargeable battery within the enclosure. The gasket may be pressed into the enclosure of the recharge port 204 to seal the opening 302 from the environment.

Figure 4:
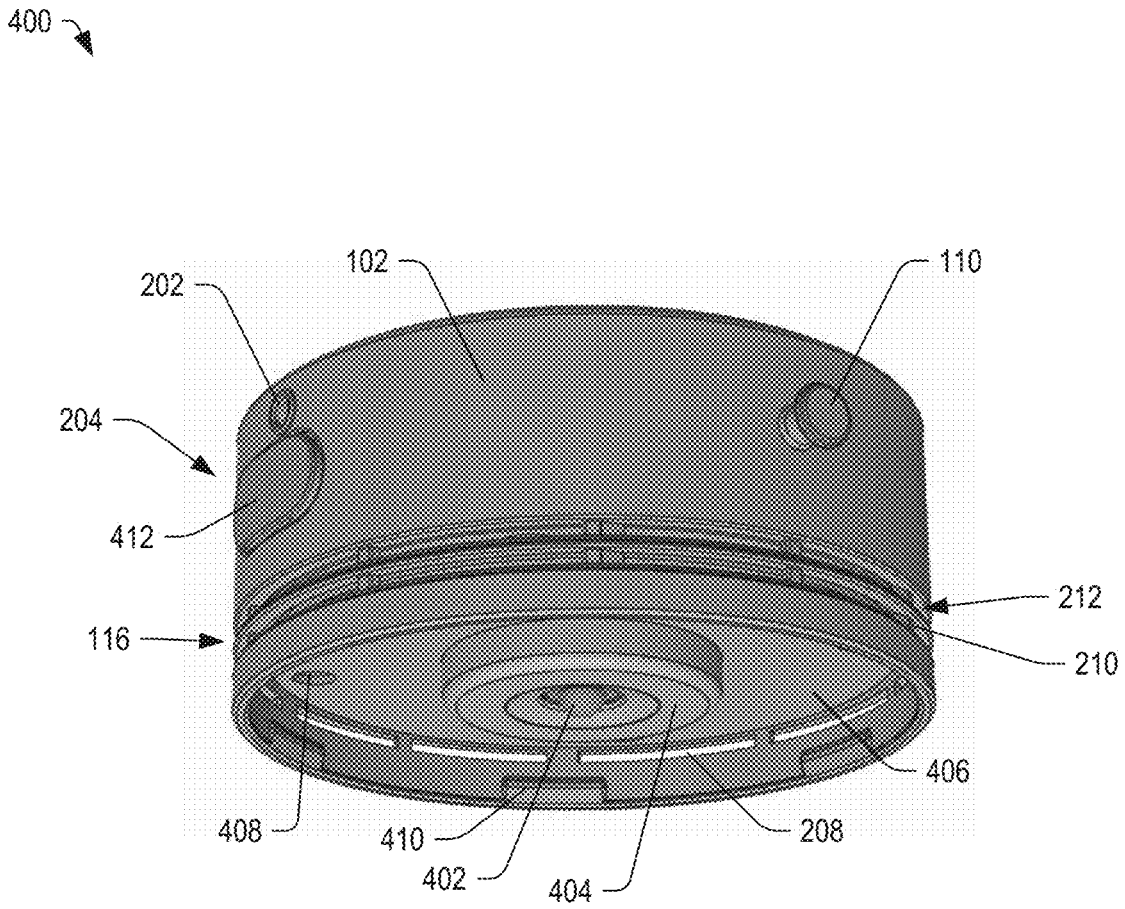
FIG. 4 depicts a bottom perspective view of a housing of the solar-powered collapsible light of FIGS. 1-3 with the shade removed and depicting a light-emitting diode coupled to a heat sink, in accordance with certain embodiments of the present disclosure.

FIG. 4 depicts a bottom perspective view 400 of the housing 102 of the solar-powered collapsible light of FIGS. 1-3 with the shade 118 removed and depicting a light-emitting diode 402 coupled to a heat sink 406, in accordance with certain embodiments of the present disclosure. The housing 102 includes the post 110, which may include a narrow portion that extends from a surface of the housing 102 and that includes a cap or lid portion configured to engage the opening 114 in the handle 112 (in FIGS. 1-3) to enable selective engagement of the housing 102 to the handle 112 to attach or detach the handle 112 as desired. Other embodiments are also possible.

In the view 400, a bottom portion of the housing 102 may include a light source, such as a light-emitting diode (LED) 402, which may include an associated heat sink and control circuit enclosed within a cover 404. The cover 404 may provide a seal to isolate the LED circuit from the environment. The cover 404 may be coupled to a heat sink 406, which may also be coupled to the heat sink of the LED circuit to facilitate heat dissipation away from the LED 402 and the associated LED circuit. The cover 404 may be coupled to the heat sink 406 by fasteners (such as screws) extending from within the housing 102 through the heat sink 406 and into openings within the cover 404. Further, the heat sink 406 may be coupled to the housing 102 by fasteners extending through openings 408 and into receiving posts within the housing 102. Other embodiments are also possible.

In the illustrated example, an inner surface of the housing 102 may include ridges or extensions 410 configured to engage a portion of the shade 118. In other embodiments, these ridges or extension 410 may be omitted.

Further, in this illustrated example, a gasket 412 is shown that may be configured to engage and seal the recharge port 204 from the ambient environment. In some embodiments, the gasket 412 may be formed from a rubber material and sized to fit within and mate with the recharge port opening. Other embodiments are also possible.

Figure 5:
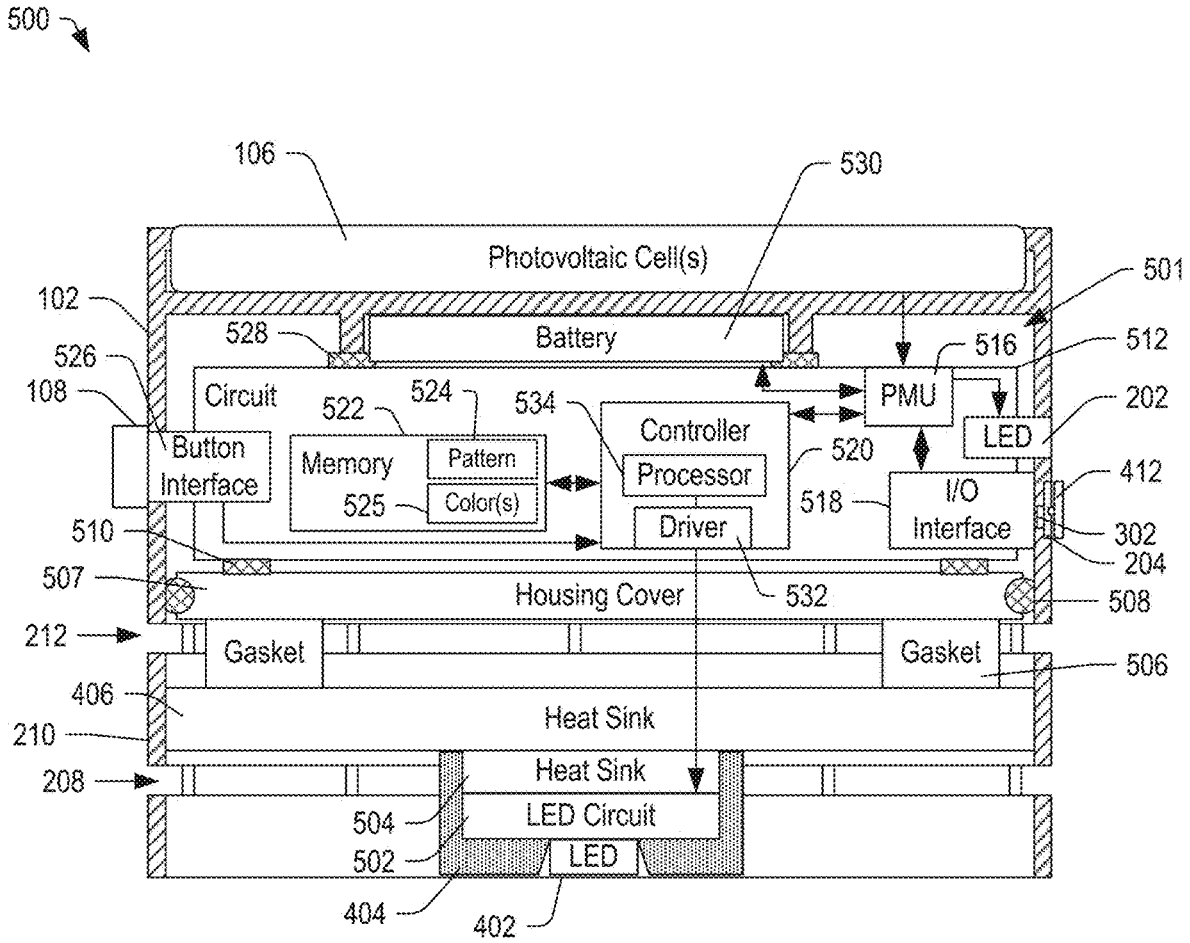
FIG. 5 depicts a partial cross-sectional side view and partial block diagram view of the housing of FIG. 4 and structures to protect and isolate circuitry within the housing from the environment, in accordance with certain embodiments of the present disclosure.

FIG. 5 depicts a partial cross-sectional side view and partial block diagram view 500 of the housing of FIG. 4 and structures to protect and isolate circuitry within the housing from the environment, in accordance with certain embodiments of the present disclosure. It should be appreciated that the example provided in FIG. 5 is one possible example of the housing portion of the solar-powered collapsible light of any of the FIGS. 1-4. Further, it should be understood that the example provided in FIG. 5 is not drawn to scale, but rather is shown for illustrative purposes.

In the view 500, the housing 102 is shown in cross-section. The housing 102 may be configured to engage and secure a solar panel including one or more photovoltaic cells 106. Further, the housing 102 may define an enclosure 501 configured to secure the circuitry and rechargeable battery from the environment. Further, the housing 102 may include air flow openings 116 including the first opening 208, the second opening 210, and the separating element 210. The heat sink 406 may be positioned relative to the housing 102 such that the heat sink 406 is aligned with the separating element 210, allowing air flow across both sides of the heat sink 406.

The cover 404 may be coupled to the heat sink 406 and may include an opening sized to allow at least a portion of the LED 402 to be visible through the cover 404. The LED circuit 502 may include or may be coupled to a heat sink 504, which may in turn be coupled to the heat sink 406 to dissipate heat from the LED circuit 502 and the LED 402. The heat sink 406 may be coupled to a housing cover 507 by fasteners (not shown), such as screws, which may be sealed by gaskets 506.

The housing cover 507, the interior surface of the housing 102, or both may include a groove or inset sized to receive an O-ring seal 508, which may cooperate with the housing cover 507 to seal the enclosure 501. Gaskets 510 may be provided to further seal the enclosure 501 adjacent to the fasteners.

The enclosure 501 may include a circuit 512 coupled to the button 108, a battery 530, the LED 202, the LED circuit 502, and an input/output (I/O) interface 518. The circuit 512 may be coupled to the housing 102 by fasteners (not shown), which may extend through gaskets 528 into posts provided within the enclosure 501. In some embodiments, the gaskets 528, 510 and 508 may provide some shock absorption and may cooperate to insulate the circuit 512 from the effects of impacts.

The circuit 512 may include a power management unit (PMU) 516 coupled to the LED 202, to the I/O interface 518, to the battery 530, and to a controller 520. In some embodiments, the PMU 516 may be configured to collect, distribute, and condition the power for operating the circuit 512 and the LED 402. The PMU 516 can include a power an overcharging protection circuit configured to prevent the rechargeable battery 530 from becoming damaged by excessive power delivered by the solar cell 106 or from an external power source via the recharge port 204. In certain examples, the rechargeable battery 530 can be charged by power produced by the solar sell 106 or using the power supplied from the external power source.

The controller 520 may be a control circuit including a processor 534, which may be configured to execute instructions stored in a memory 522. The controller 520 may also include a driver circuit 532 to drive the LED circuit 502. The memory 522 may be coupled to the controller 520. The memory 522 may include pattern instructions 524 that can be used by the processor 534 to control the driver 532 to drive the LED circuit 502 to turn the LED 402 on and off according to a pattern. The memory 522 may also include color instructions 525 that, when executed, cause the processor 534 to control the driver 532 to drive power to the LED circuit 502 at a selected power level (or optionally at a selected frequency) to activate the LED 402 to emit light having a particular wavelength. In a particular example, the LED 402 may be controlled to emit light, such as a substantially white light, a green light, a blue light, a red light, an ultraviolet light, another wavelength of light, or any combination thereof. In a particular example, the pattern instructions 524 and the color instructions 525 may be executed substantially concurrently to control the LED 402 to emit light according to a particular pattern (such as a Morse code pattern), a particular color, a pattern of one or more colors, or any combination thereof.

The circuit 512 may include a button interface 526 configured to engage a button 108 external to the housing 102. The button interface 526 may generate an electrical signal in response to a button press event and may provide the electrical signal to the controller 520. In some embodiments, the controller 520 may include an analog-to-digital converter (ADC) that may be configured to convert received signals into digital signals that can be used the by the processor. In other embodiments, the button interface 526 may include the ADC. Further, in some embodiments, the circuit 512 may include or may be coupled to one or more sensors, such as a light sensor, a temperature sensor, other sensors, or any combination thereof. In an example, the controller 520 may be configured to receive a signal from the light sensor and may be configured to automatically activate the LED 402 to emit light when the signal is below a threshold level.

In some embodiments, the I/O interface 518 may be coupled to the recharge port 204, which may include the opening 302 to receive the micro USB connector. Further, the gasket 412 is shown, which may be coupled to the recharge port 204 by a flexible hinge (which may be integrally formed as part of the gasket 412) and which may be opened to allow access to the opening 302 or may be closed to seal the opening 302 from the environment. The I/O interface 518 may be coupled to the opening 302 to receive the micro USB connector for supplemental charging of the battery or batteries 530.

In some embodiments, the positioning of the heat sink 406 between the openings 208 and 212 allows for air flow across both sides of the heat sink, enhancing heat dissipation from the LED circuit 502 and from the LED 402. In certain embodiments, improving the heat dissipation may extend the usable life of the LED circuit 502, as compared to conventional designs, which may enclose at least a portion of the heat sink within the environmentally sealed housing trapping the heat and potentially damaging the circuitry.

In some embodiments, the gaskets 506, 510, and 528 (as well as additional gaskets that are not shown), and the O-ring seal 508 may serve dual functions. With respect to the first function, the gaskets 506, 510, and 528 (and any additional gaskets) and the O-ring seal 508 can operate to seal the enclosure 501 from the outside environment. With respect to the second function, the gaskets 506, 510, and 528 (and any additional gaskets) and the O-ring seal 508 may be compressible and may operate to absorb impact-related forces to reduce the effect of impacts on the circuit 512 and the LED circuit 502. Further, when attached, the shade 118 may also operate to absorb impact forces, thereby protecting the circuit 510, the LED circuit 502, and internal electrical connections from damage due to impact.

Figure 6:
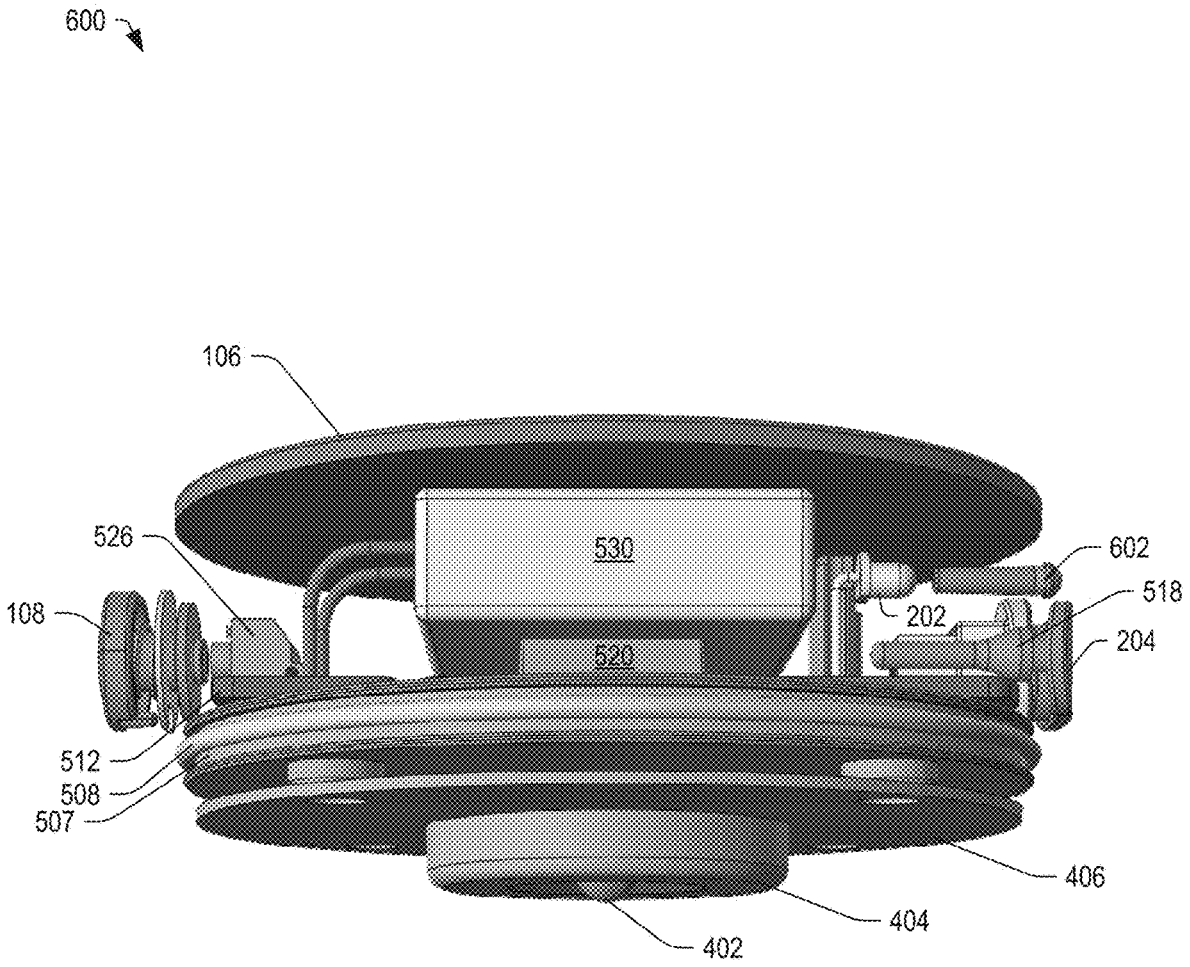
FIG. 6 depicts a perspective view of components of the solar-powered collapsible light of FIGS. 4 and 5, in accordance with certain embodiments of the present disclosure.

FIG. 6 depicts a perspective view 600 of components of the solar-powered collapsible light of FIGS. 4 and 5, in accordance with certain embodiments of the present disclosure. In this view 600, some of the components, such as the gaskets and fasteners, have been removed for ease of illustration.

In view 600, the LED 402 is partially enclosed by the cover 404, which is coupled to the heat sink 406. The heat sink 406 is coupled to the housing cover 507 to which the O-ring seal 508 is coupled. The circuit 512 is coupled to the housing cover 507 and is coupled to the indicator light 202 and via the I/O interface 518 to the recharge port 204. In some embodiments, the PMU 516 in FIG. 5 may detect a current received via the I/O recharge port 204 and may activate indicator light 202 to indicate that a supplemental recharge operation is in progress. In the illustrated example, a light extender or light pipe 602 is provided to deliver the light emitted by the indicator light 202 to an exterior surface of the housing 102.

Further, the view 600 depicts the controller 520 coupled the circuit 512 and the battery 530 positioned beneath the solar panel 106 and coupled to the circuit 512. Further, the button interface 526 is coupled to the button 108 and coupled to the circuit 512. It should be appreciated that the button 108 may include a mechanical feature configured to enable a user to press the button and may include a spring configured to push the button 108 back to its starting position. A switch associated with the button interface 526 may be configured to detect the button press event and to convert the button press event into an electrical signal.

Figure 7:
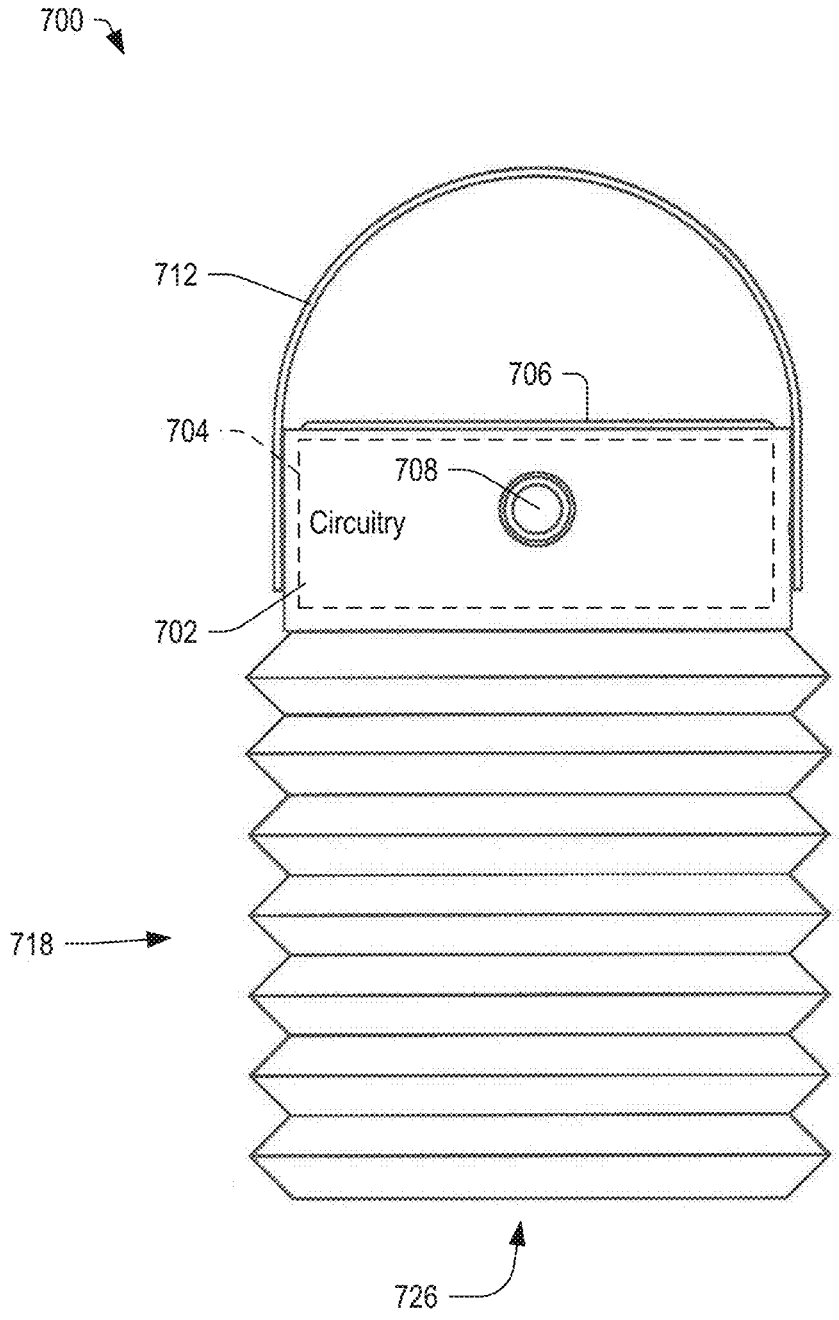
FIG. 7 depicts a front view of a solar-powered collapsible light including a shade in an expanded state, in accordance with certain embodiments of the present disclosure.

FIG. 7 depicts a front view of a solar-powered collapsible light 700 including a shade 718 in an expanded state, in accordance with certain embodiments of the present disclosure. The solar-powered collapsible light 700 may include all of the elements of and the functionality described above with respect to the solar-powered collapsible light of FIGS. 1-6. In this example, the handle 712 may be permanently fixed to the housing 702, but may be hinged so that it can be folded into a retracted state. The housing 702 may include circuit 704, which may include the circuit 512, the battery 530, the LED circuit 502, the LED 402. Further, the housing 702 may be coupled to a solar panel 706, which may include one or more solar cells. Further, the housing 702 may include a button 708 accessible by a user to adjust the operation of the light source.

In this example, the heat sink 406, the LED circuit 502 and the LED 402 may be external to the housing 702. However, the openings 116 (discussed with respect to the housing 102 in FIGS. 1-6 may be omitted. In this instance, the air flow may be across one or both sides of the heat sink 406 through and through the opening 726 at the end of the collapsible shade 718.

Figure 8:
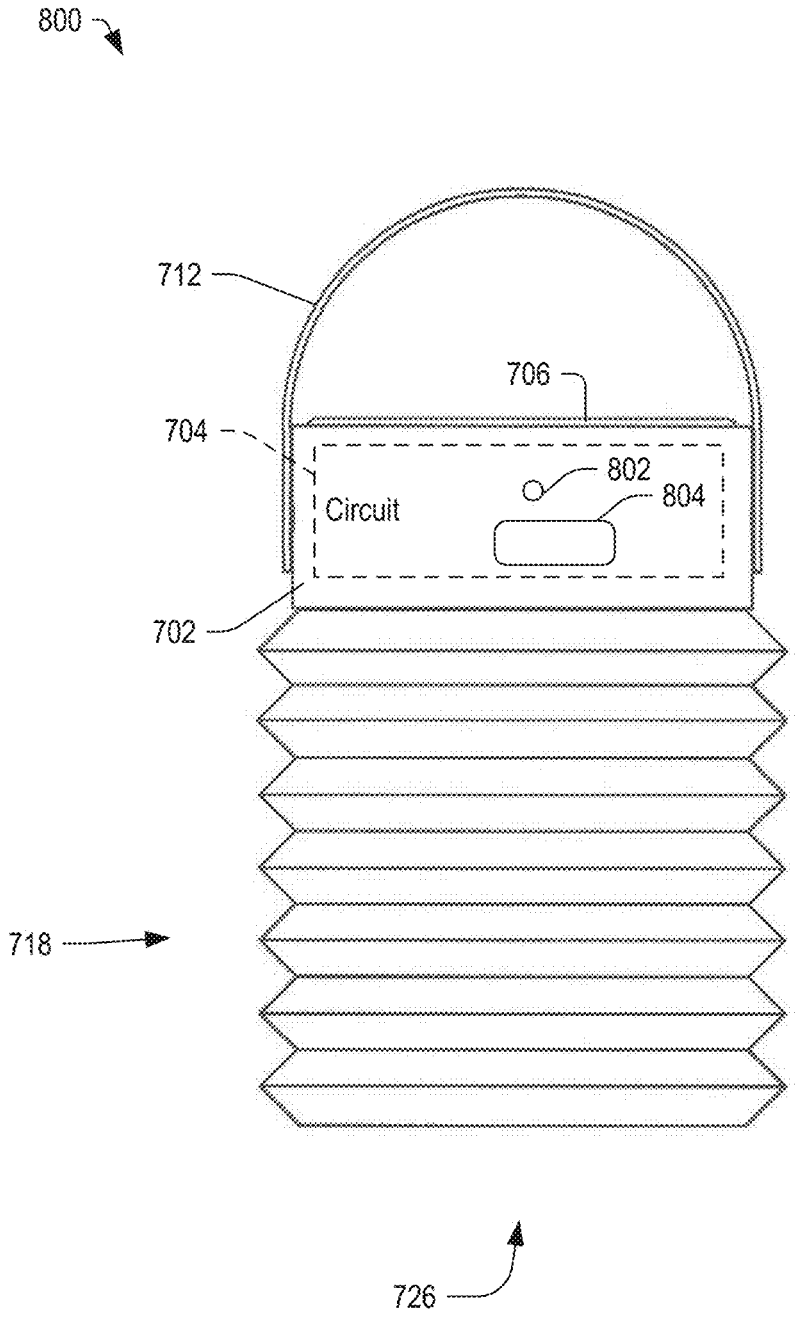
FIG. 8 depicts a rear view of the solar-powered collapsible light including a indicator light and a recharge port, in accordance with certain embodiments of the present disclosure.

FIG. 8 depicts a rear view 800 of the solar-powered collapsible light including a indicator light and a recharge port, in accordance with certain embodiments of the present disclosure. In this example, the indicator light 802 and the recharge port 804 are shown.

Figure 9:
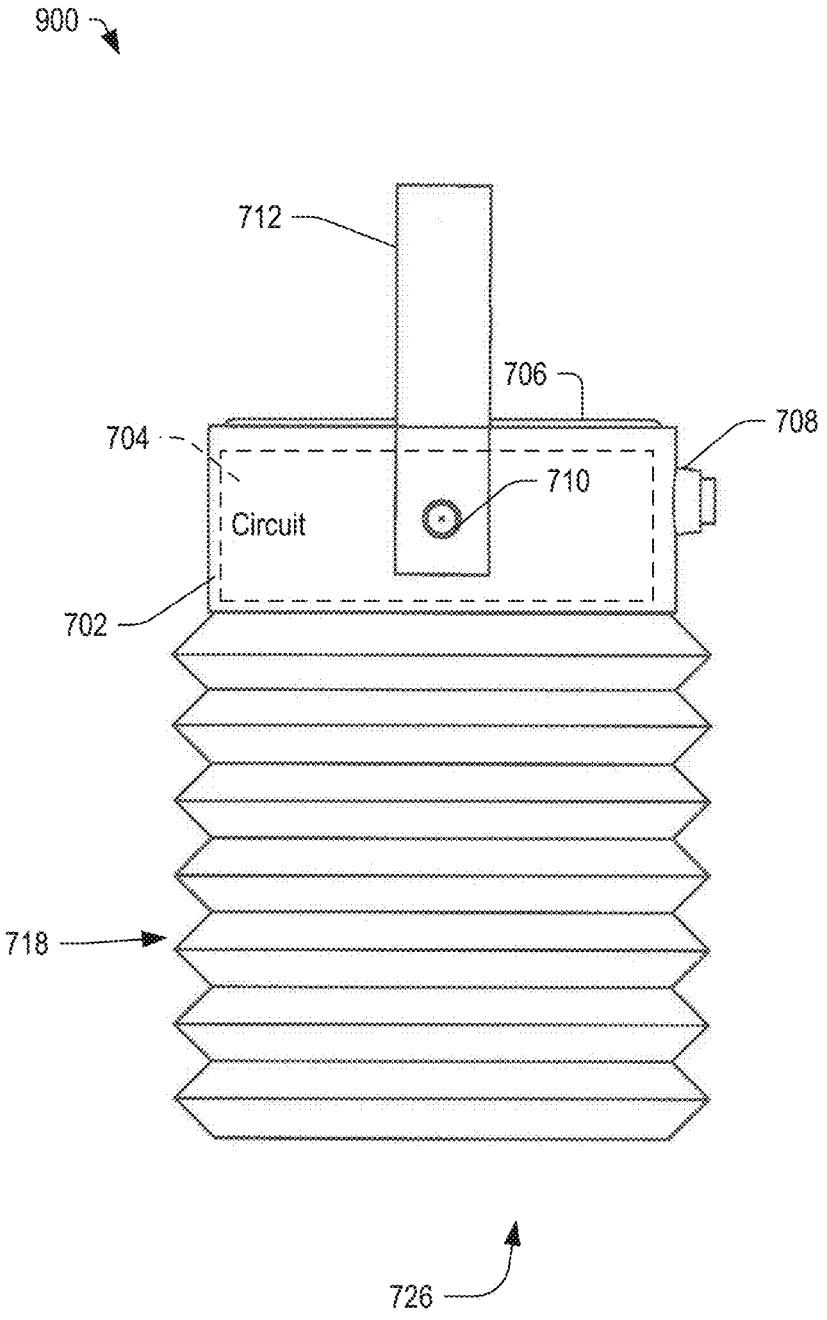
FIG. 9 illustrates a side view of the solar-powered collapsible light of FIGS. 7 and 8, in accordance with certain embodiments of the present disclosure.

FIG. 9 illustrates a side view 900 of the solar-powered collapsible light of FIGS. 7 and 8, in accordance with certain embodiments of the present disclosure. In this embodiment, the button 708 may extend beyond a profile of the surface of the housing. In the embodiments of FIGS. 1-6, the button 108 was flush with the surface of the housing 102 and/or was enclosed within a portion of the housing 102 that extended outward from the surface. Other embodiments are also possible.

Further, handle 712 is coupled to the housing 702 by a hinged coupling 710, which may allow the handle 712 to pivot about the hinged coupling 710 into a retracted state. Other embodiments are also possible.

Figure 10:
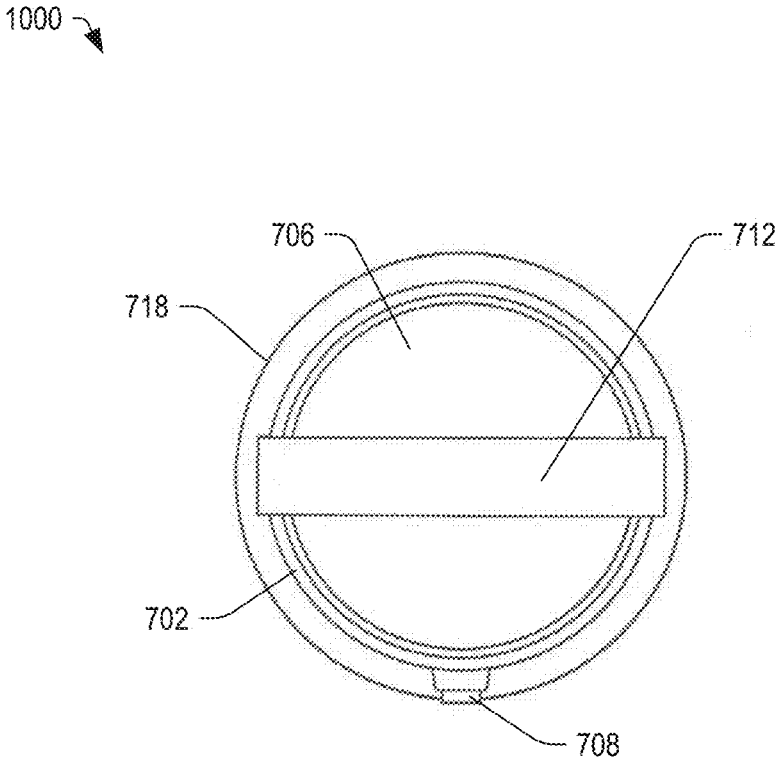
FIG. 10 illustrates a top view of the solar-powered collapsible light of FIGS. 7-9 including a photovoltaic cell, in accordance with certain embodiments of the present disclosure.

FIG. 10 illustrates a top view 1000 of the solar-powered collapsible light of FIGS. 7-9 including a photovoltaic cell, in accordance with certain embodiments of the present disclosure. In this illustrated example, it can be seen that the collapsible shade 718 may have a diameter that is larger than the diameter of the housing 702.

In a particular embodiment, when dropped, the shade 718 and the handle 712 may cooperate to absorb at least a portion of the impact. In combination with the internal gaskets and the O-ring seal (as discussed above with respect to FIG. 5), the various components may cooperate to provide enhanced impact resistance as compared to conventional illumination devices.

Figure 11:
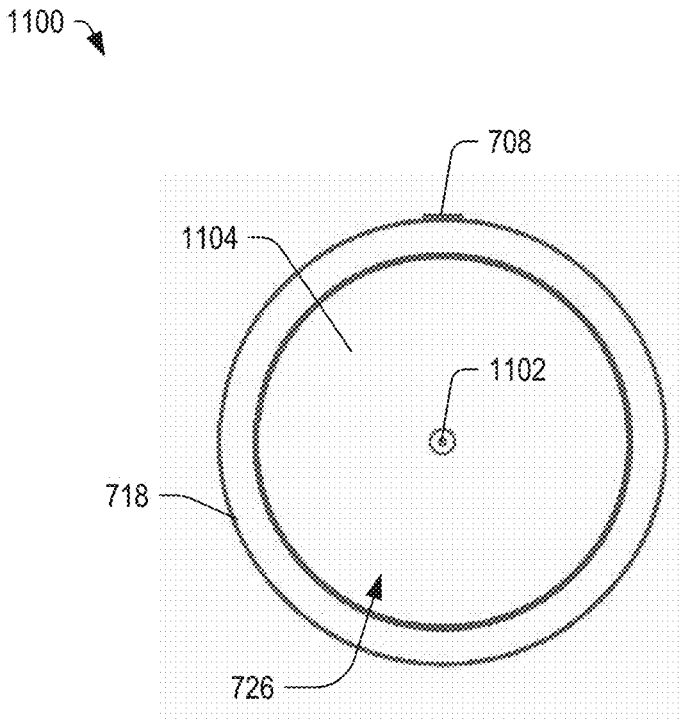
FIG. 11 depicts a bottom view of the solar-powered collapsible light of FIGS. 7-10 including a light source coupled to a heat sink, in accordance with certain embodiments of the present disclosure.

FIG. 11 depicts a bottom view 1100 of the solar-powered collapsible light of FIGS. 7-10 including a light source 1102 coupled to a heat sink 1104 (as seen through the open end 726 of the collapsible shade 718, in accordance with certain embodiments of the present disclosure. In this example, a portion of the collapsible shade 718 may be positioned between the heat sink 1104 and the housing 702 to provide a space between the heat sink 1104 and a cover of the housing 702 allowing at least some air flow on both sides of the heat sink 1104. In some embodiments, one or more gaskets may be provided between the heat sink 1104 and the cover of the housing 702 providing an air gap for air flow and providing additional impact resistance. Other embodiments are also possible.

Figure 12:
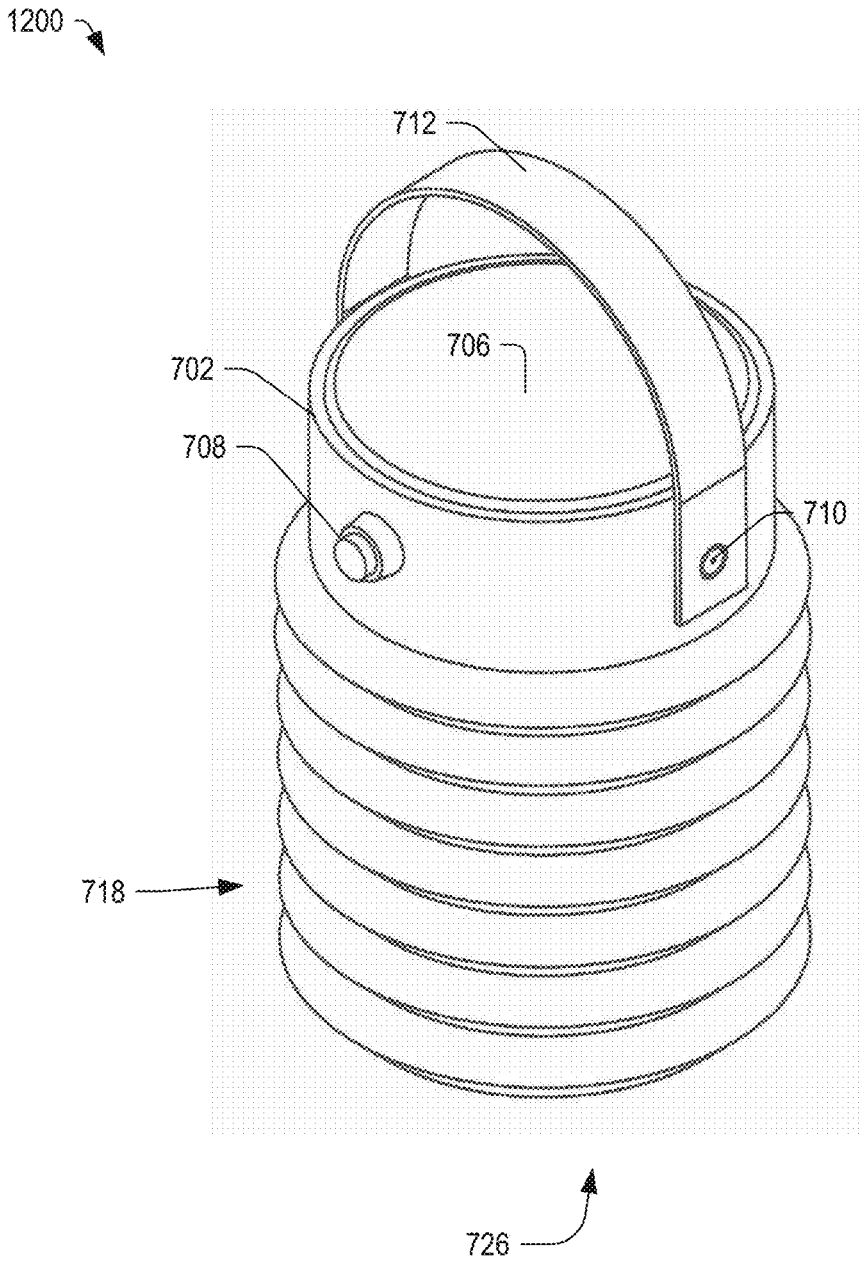
FIG. 12 depicts a top perspective view of the solar-powered collapsible light of FIGS. 7-11, in accordance with certain embodiments of the present disclosure.

FIG. 12 depicts a top perspective view 1200 of the solar-powered collapsible light of FIGS. 7-11, in accordance with certain embodiments of the present disclosure. As shown, the button 708 extends beyond a profile of the surface of the housing 702.

Figure 13:
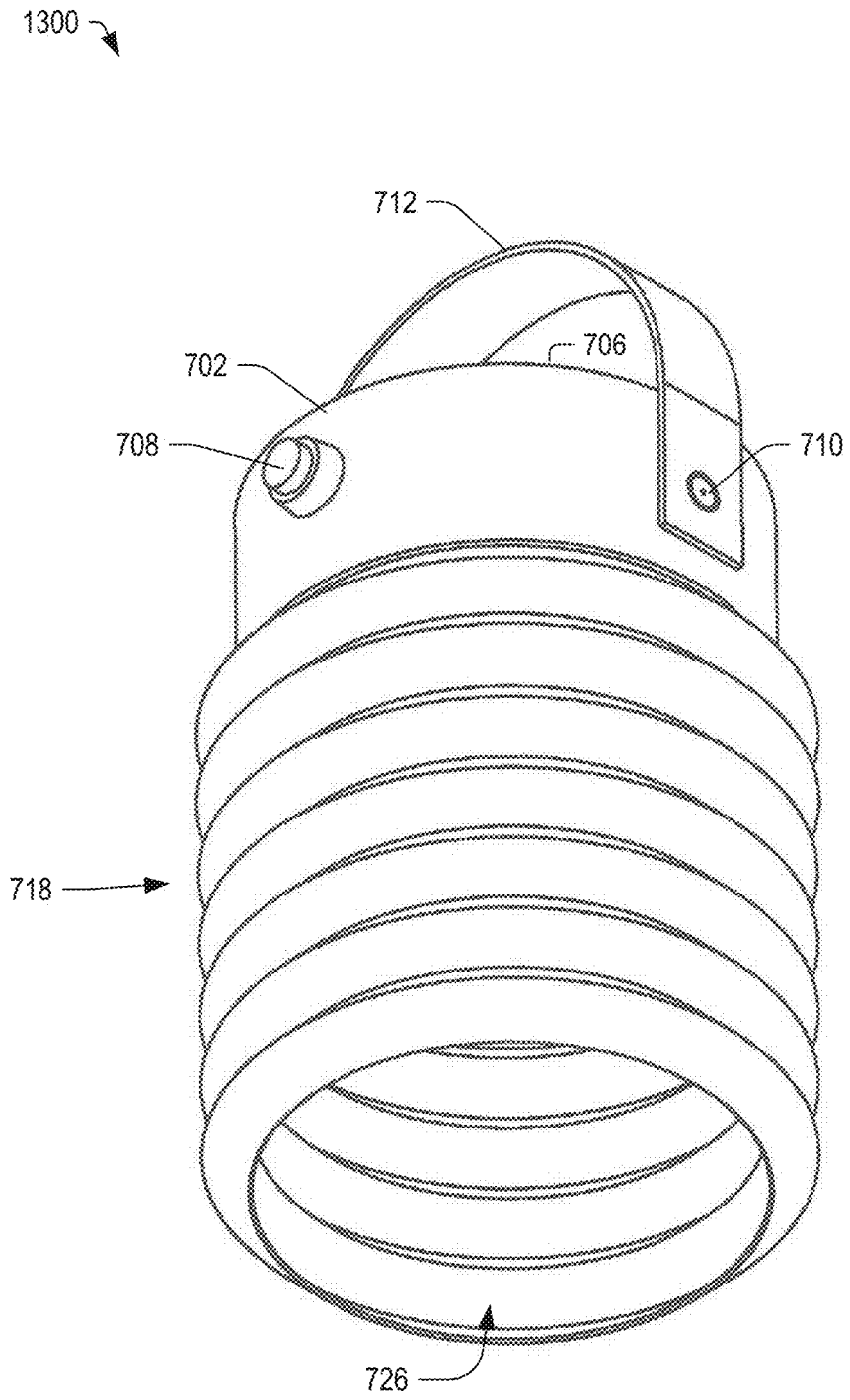
FIG. 13 depicts a bottom perspective view of the solar-powered collapsible light of FIGS. 7-12 and including an open end of the expanded shade, in accordance with certain embodiments of the present disclosure.

FIG. 13 depicts a bottom perspective view 1300 of the solar-powered collapsible light of FIGS. 7-12 and including an open end 726 of the expanded shade 718, in accordance with certain embodiments of the present disclosure. The open end 726 facilitates air flow across the heat sink 1104.

Figure 14:
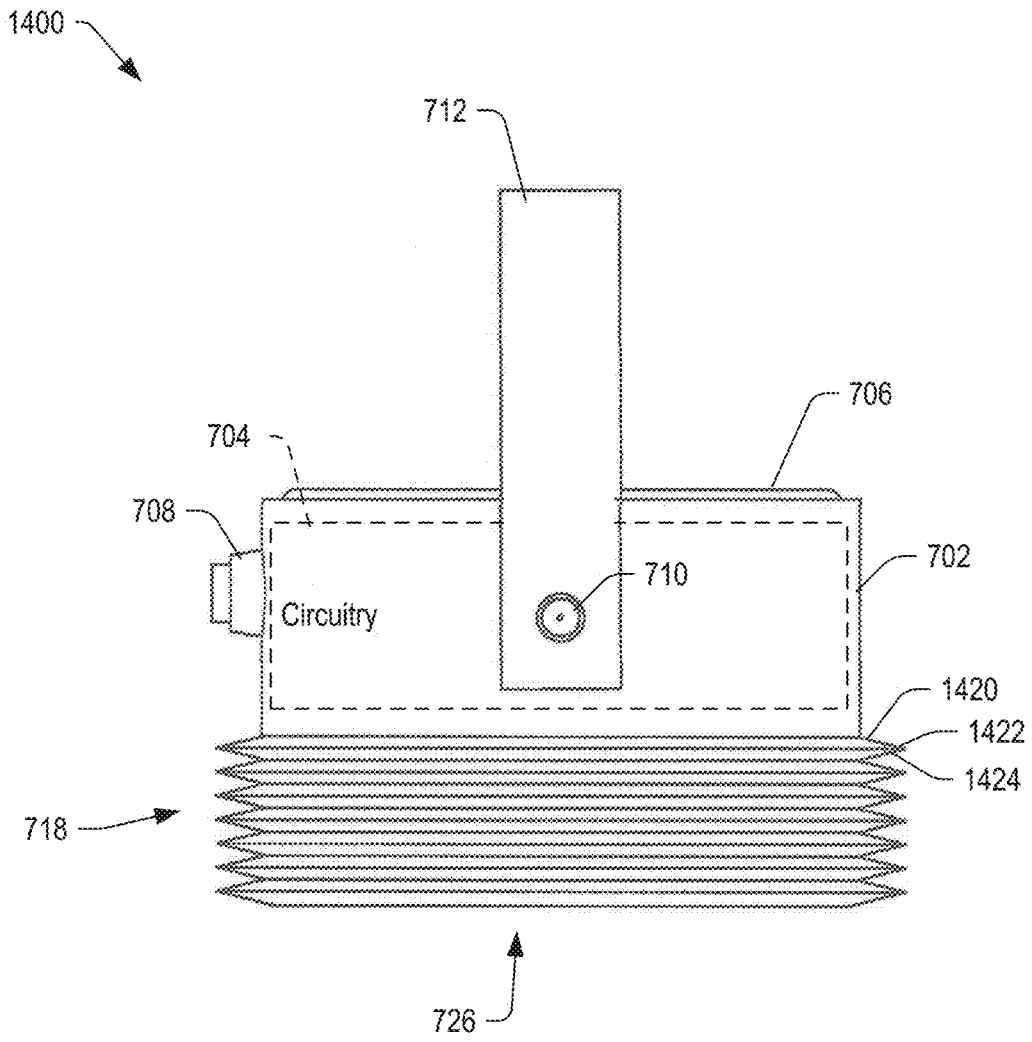
FIG. 14 depicts a side view of the solar-powered collapsible light of FIGS. 7-13 and including the shade in a collapsed state, in accordance with certain embodiments of the present disclosure.

FIG. 14 depicts a side view 1400 of the solar-powered collapsible light of FIGS. 7-13 and including the shade 718 in a collapsed state, in accordance with certain embodiments of the present disclosure. The shade 718 includes a plurality of pleats including a first pleat 1420, a second pleat 1424, and a reinforced portion 1422 between the first and second pleats 1420 and 1424. The reinforced portion 1422 may be configured to maintain the first and second pleats 1420 and 1424 either in an extended state (as depicted in FIGS. 7-13) or in a collapsed state as illustrated in this example.

It should be appreciated that each pair of pleats 1420 and 1424 may be separately adjusted so that the shade 718 may be fully collapsed, fully extended, or partially extended, depending on the intended use. The reinforced portions 1422 maintain each pleat 1420 and 1424 in the selected state. Further, the reinforced portions 1422 allow shade 718 to be used as a support or platform for holding the housing 702. Other embodiments are also possible.

Figure 15:
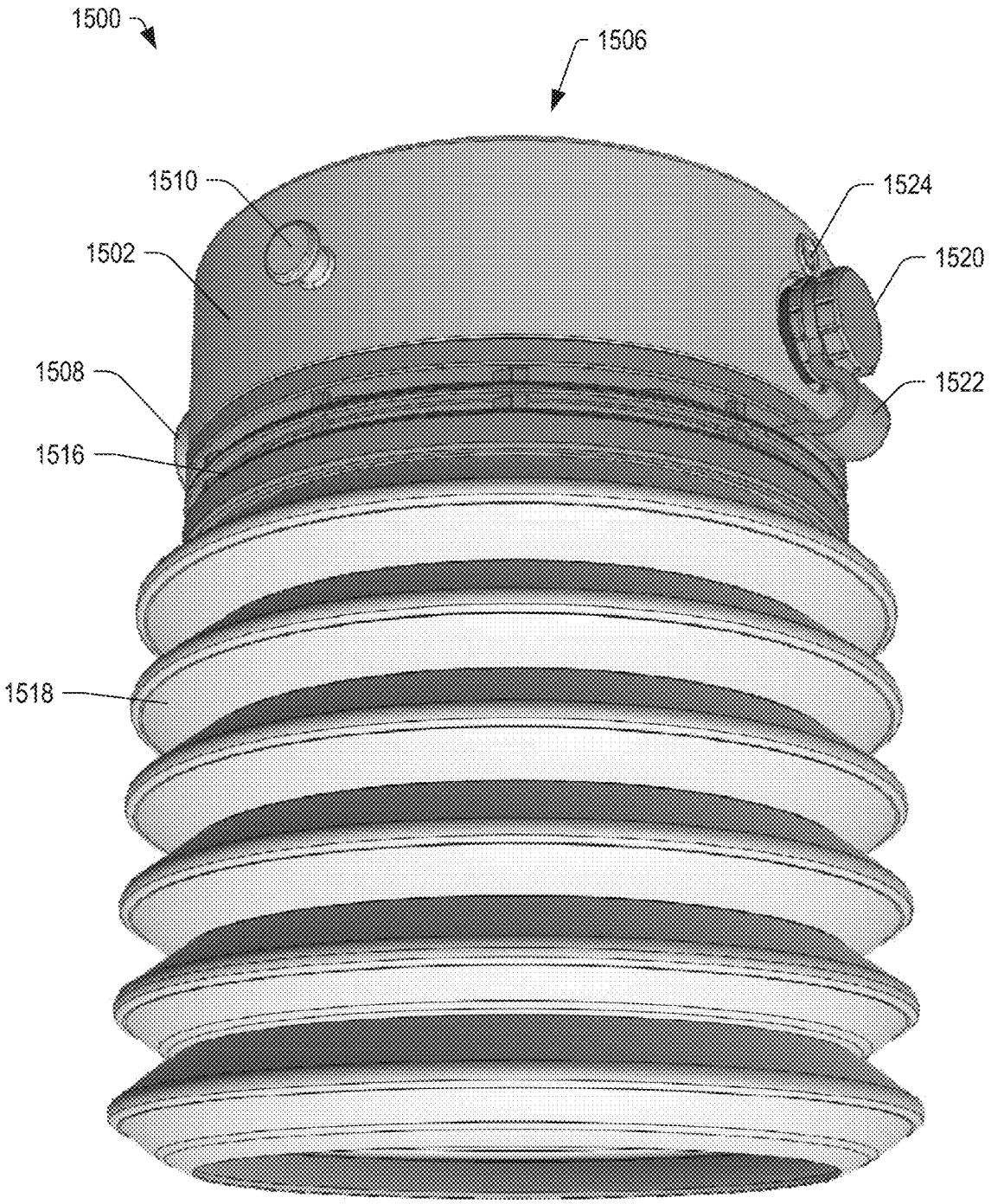
FIG. 15 depicts a perspective view of a solar-powered collapsible light including a housing having a screw-cover for a recharge port, in accordance with certain embodiments of the present disclosure.

FIG. 15 depicts a perspective view 1500 of a solar-powered collapsible light including a housing 1502 having a screw-cover 1520 for a recharge port, in accordance with certain embodiments of the present disclosure. In this example, the housing 1502 may include a post 1510 configured to engage openings in a handle (such as the handle 112 in FIG. 1) to selectively secure the handle to the housing 1502. Further, the housing 1502 may include a button 1508 and a solar panel 1506. The housing 1502 may also include an indicator light 1524 and an associated recharge port, which may be covered by the screw-cover 1520. In this example, the screw-cover 1520 is coupled to one of the openings 1516 by a flexible hinge element 1522. The housing 1502 may also be coupled to a collapsible shade 1518.

The example in FIG. 15 may be an embodiment of any of the solar-powered collapsible lights of FIGS. 1-14 and may include the circuitry and the functionality described above with respect to FIGS. 1-14.

Figure 16:
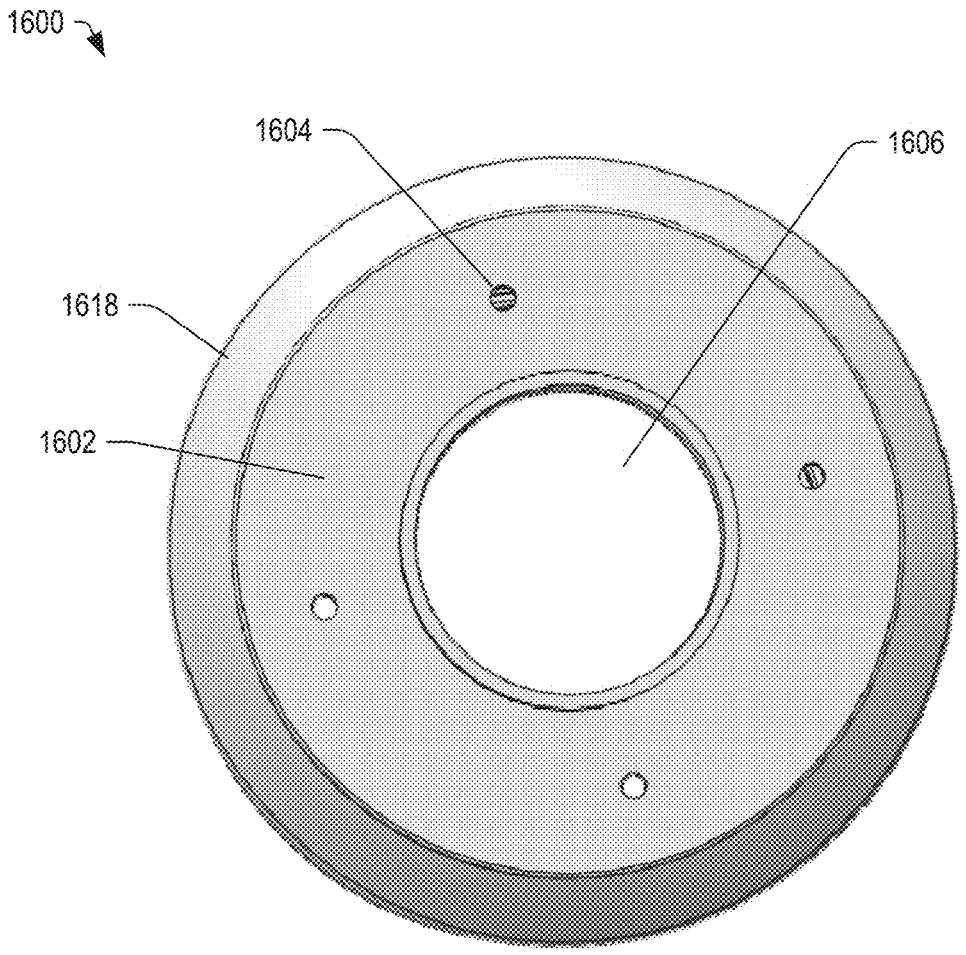
FIG. 16 depicts a top view of a collapsible shade that can be used with any of the embodiments of FIGS. 1-15, in accordance with certain embodiments of the present disclosure.

FIG. 16 depicts a top view 1600 of a collapsible shade 1618 that can be used with any of the embodiments of FIGS. 1-15, in accordance with certain embodiments of the present disclosure. The shade 1618 is an embodiment of the shade 118 of FIGS. 1-6), the shade 718 of FIGS. 7-14, or the shade 1518 in FIG. 15. A top portion of the shade 1618 includes a mounting surface 1602 defining an opening 1606 sized to fit around the cover of the light emitting diode circuit, such as the cover 404 in FIGS. 4 and 5. The heat sink 406 may be coupled either between the mounting surface 1602 and the housing cover or between the mounting surface 1602 and the opening 126, 726, or 1526, for example (i.e., inside of the collapsible shade 1618.

Further, openings 1604 may be provided in the mounting surface 1602 to receive fasteners for coupling the shade 1618 to the housing. In some embodiments, gaskets may be provided one or both sides of the heat sink, such as between the mounting surface 1602 and the heat sink and between the heat sink and the housing. Other embodiments are also possible.

Figure 17:
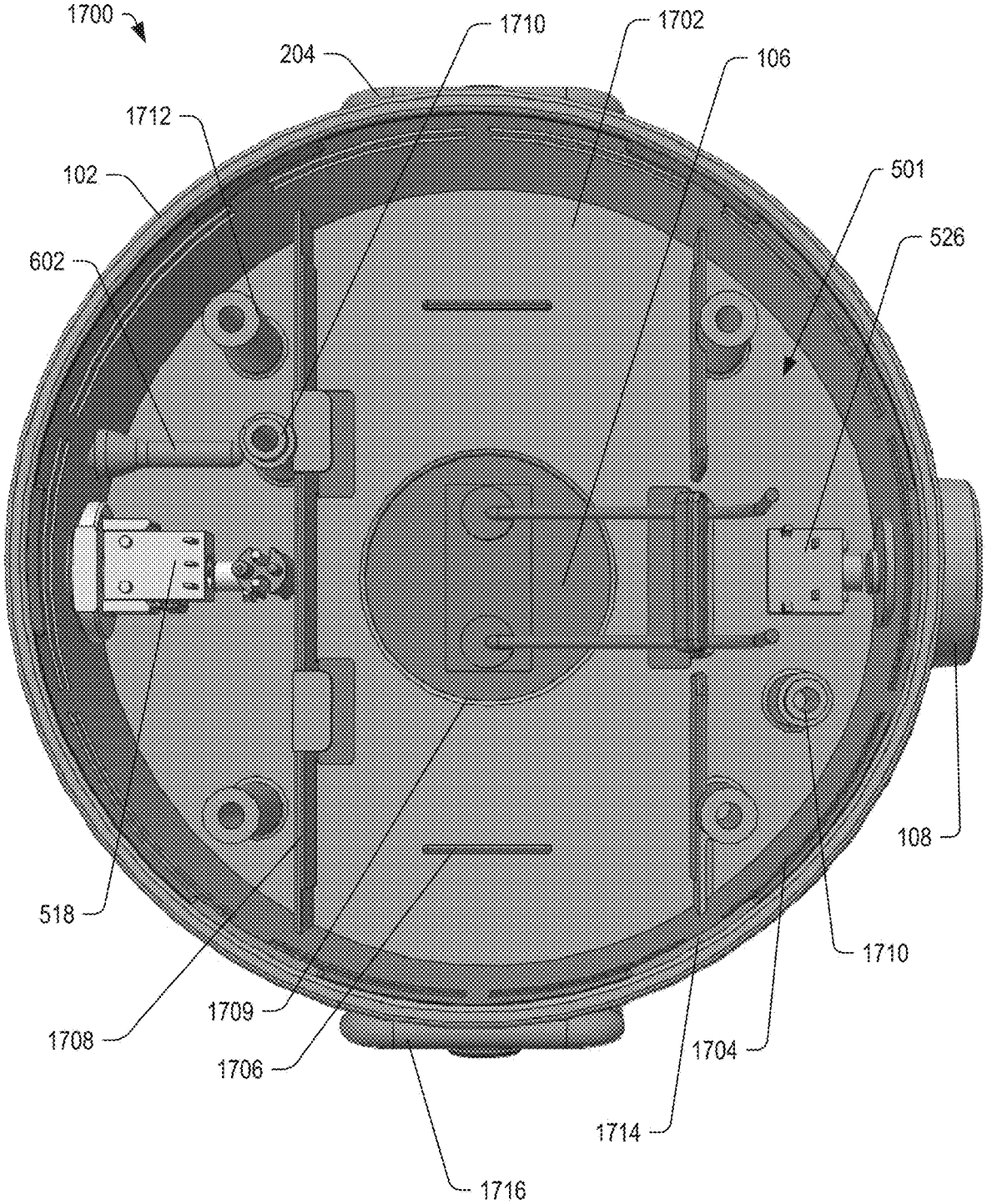
FIG. 17 depicts a bottom view of the housing of any of the FIGS. 1-5 and 7-15 with many of the components removed, in accordance with certain embodiments of the present disclosure.

FIG. 17 depicts a bottom view 1700 of the housing 102 of any of the FIGS. 1-5 and 7-15 with many of the components removed, in accordance with certain embodiments of the present disclosure. The housing 102 includes a bottom surface 1702 and sidewalls 1704, which cooperate to define the enclosure 501. The enclosure 501 includes support elements 1706 on the bottom surface 1702 and support walls 1708, which cooperate to support and secure the rechargeable battery 530 (in FIG. 5). The battery may be positioned against the bottom surface 1702 on the support elements 1706 and between the support walls 1708. The housing 102 may also include an opening 1709 to allow access from the solar panel 106 through the opening 1709 to the circuit 512 within the enclosure 501. Further, the housing 102 includes posts 1710 extending from the bottom surface 1702 and less than a height of the sidewall 1704. The circuit 512 may be coupled to the posts 1710. In some embodiments, gaskets may be mounted on an end of the posts 1710 between the posts 1710 and the circuit 512 to provide some shock-absorption capability. Further, the housing 102 may include space for an optional light sensor and for additional components.

In some embodiments, the inner surface of the sidewall 1704 may include appendages or hooked ends 1714, which may be configured to engage a surface of the cover of the housing 102. The posts (support or connecting rods) 1712 extend from the bottom surface 1702 to approximately a height of an opening 212 (in FIG. 2). The ends of the posts 1712 may be inserted into cavities in the housing cover 507. The housing cover 507 may be used to support the heat sink 506 and the LED circuit 502, the heat sink 504, the LED cover 404, and the LED 402.

In the illustrated example of FIG. 17, an additional gasket 1716 is provided that may close an opening into the housing 102 and that may provide access to a port, such as a USB port, another port, or any combination thereof. In a particular example, the patterns, the voltage levels, or other operations of the controller 520 may be programmable and may be accessed via the port. Other embodiments are also possible.

Figure 18:
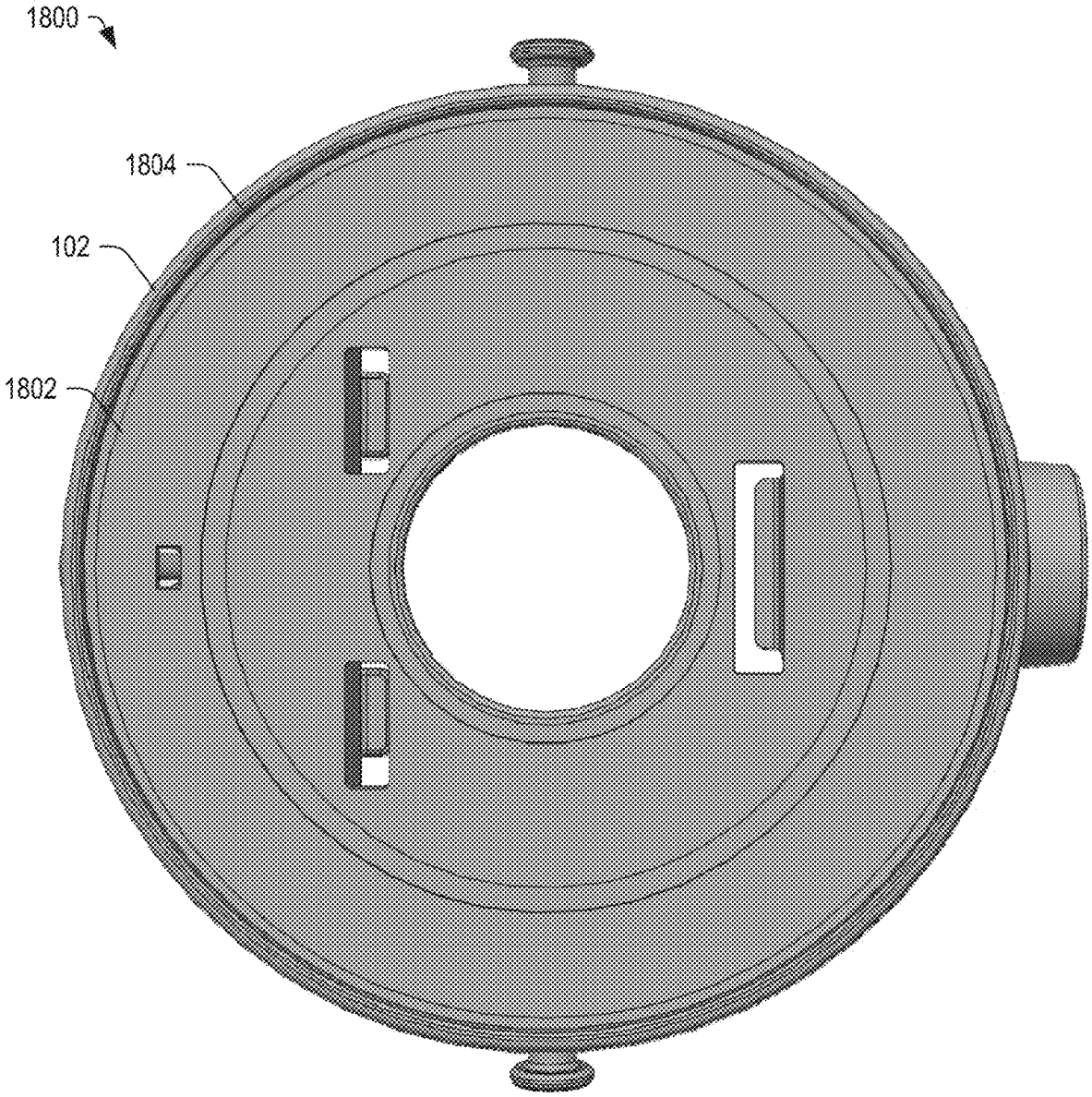
FIG. 18 depicts a top view of the housing of any of the FIGS. 1-5, 7-15, and 17 with the solar panel removed, in accordance with certain embodiments of the present disclosure.

FIG. 18 depicts a top view 1800 of the housing 102 of any of the FIGS. 1-5, 7-15, and 17 with the solar panel removed, in accordance with certain embodiments of the present disclosure. The housing 102 defines a recessed area 1802 sized to receive the solar panel 106. In some embodiments, the sidewalls 1804 defined the recessed area 1802 may include a slight overhang configured to engage and secure the solar panel. In some embodiments, an O-ring seal and one or more gaskets may be provided between the housing 102 and the solar panel 106 to seal the enclosure from the environment. Other embodiments are also possible.

It should be understood that, for ease of shipment, transport and storage, in some embodiments, the solar-powered collapsible lighting apparatus described above with respect to FIGS. 1-18, can be packaged unassembled and assembled when needed. In one particular embodiment of an assembly method, the collapsible shade, the support unit and the hanging device can be provided unassembled. The collapsible shade may be expanded to its deployed state. The support unit may be assembled by connecting the bottom portion of the housing to a top portion of the shade using a connector. The assembled support unit can then positioned within the deployed collapsible shade such that the top portion can be positioned within or proximate to the top opening of the collapsible shade and the bottom portion is positioned within or proximate to the bottom opening of the collapsible shade. The hanging device can then be attached to the top portion of the housing.

As set forth above, the collapsible shade includes the bottom opening and the top opening. Further, a top portion of the housing includes the cavities and the appendages and can be used to secure the lighting element assembly, the solar cell, the battery unit, and the associated circuitry.

In certain embodiments, the lighting element assembly can include a lighting element cover, the lighting element and the circuit board. In a collapsed state, the solar-powered collapsible lighting apparatus can be easily shipped, transported and stored. For maximum benefit, the solar-powered collapsible lighting apparatus should be as thin as possible when in the collapsed state. In some embodiments, the solar-powered collapsible lighting apparatus may have a thickness of approximately one inch when in the collapsed state.

In certain embodiments, the solar-powered collapsible light can be a portable device used to generate energy from sunlight, to store the energy, and to selectively emit light in response to user-selection of a button (or in response to sensed low-light levels). In conjunction with the embodiments described above with respect to FIGS. 1-18, a solar-powered collapsible light can include a cylindrical housing configured to secure a battery and associated circuitry. The housing may be coupled to a solar cell and may be selectively coupled to a handle or strap. Further, the housing may be coupled to a collapsible shade. The housing may include circuitry configured to control a light source and to control charging of a rechargeable battery as well as power distribution from the battery.

In certain embodiments, the housing may be a rigid puck-shaped housing that can be used to secure, isolate and protect the electrical components. An upper surface of the housing may include a solar panel formed from one or more photo-voltaic cells. Further, the surface of the housing may include a button or switch, a post configured to engage a strap, a light source mounting surface, a shade mounting surface, and one or more sealed openings that can be accessed by a user.

In conjunction with the embodiments of the solar-powered collapsible light described above with respect to FIGS. 1-18, a solar-rechargeable light apparatus may include a user-accessible button on an exterior surface of the housing that may be selected to adjust operation of an LED, including emitting a steady beam at a first intensity in response to a first button press, at a second intensity in response to a second button press, at a third intensity in response to a third button press, and turning off in response to a fourth button press. Other operations may include holding the button in a depressed position for a period of time to cause the apparatus to selectively emit light (i.e., flash) according to a pre-determined pattern. Still other operations may include changing the color emitted by the LED. In some embodiments, the button may be a multi-state switch (button, toggle, or joystick) that can be accessed by a user to alter the state of the switch in order to access one or more of the pre-determined operations. In an alternative embodiment, the multi-state switch can include a digital interface, such as a touch screen. Other embodiments are also possible In some embodiments, a removable strap may be selectively coupled to the housing via bars or posts that can protrude from the exterior surface of the housing. The posts may be inserted into connection openings provided in the retention strap to couple the strap to the housing. In an alternative embodiment, the strap connection may include mechanical fasteners, such as clamps, latches, or the like, configured to establish a connection between the strap or handle and the housing. In some embodiments, the strap or handle connections may enable the strap or handle to pivot about the attachment point, similar to the handle of a bucket.

In some embodiments, the light source may include an LED and an LED circuit including a heat sink, which may be coupled to a second heat sink. The second heat sink may be coupled to a cover of the housing and may be configured to maintain the light source in a desired position on the exterior surface of the housing. Further, the LED circuit may be electrically coupled to circuitry within the housing such that the light source is maintained in electrical communication with the power supply and power circuit. In some embodiments, the coupling between the housing and the light source makes it possible for a user to remove and replace the light source as needed.

In certain embodiments, the shade may be a collapsible structure formed from a plurality of pleats coupled by reinforced portions. In an example, the collapsible shade can be formed from a semitransparent material, and the shade may have a length that can be adjusted to facilitate illumination or storage. In a particular embodiment, a collapsible shade may be manufactured from a tube of corrugated material. The overall length of the collapsible shade can be modified by extending or compressing a plurality of concentric ridges (pleats), which are connected to form a tube-like structure. The collapsible shade may have a substantially cylindrical or tube-like shape with openings at either end. On one end of the tube, the shade includes a mounting surface, which can be used to establish a mechanical connection with the shade mount of the housing using screws. In an alternative embodiment, an adhesive can be used to form a permanent connection between the shade and the housing. The collapsible shade may allow light to pass through and may be configurable by a user to provide a collapsed state, an expanded state, or an intermediate state. In some embodiments, extending or retracting the collapsible shade may modify the quality and diffusion of light cast into the surrounding area by the light source. That is, the shade is coupled to the same face of the housing as the light source, and thus enables the collapsible shade to cover, expose, and/or diffuse the emitted light.

In certain embodiments, the housing defines an enclosure that can function as a component compartment, which may include a battery mount configured to secure the rechargeable battery and a compartment cover configured to seal the enclosure from the environment. The component compartment can be accessed by removing the component cover by unscrewing one or more screws such that a user is able to access the interior of the component compartment.

The solar panel (one or more photo-voltaic cells) is used to convert sunlight into the electricity that can charge the rechargeable battery. In some embodiments, the solar cell may include a solar cell fastener, which establishes a mechanical connection between the solar panel and a mounting feature of the housing. Additionally, the solar cell fastener can secure the solar cell in electrical communication with the power supply through the solar cell mount and a power management unit.

Although the present invention has been described with reference to preferred embodiments, workers skilled in the art will recognize that changes may be made in form and detail without departing from the scope of the invention.

What is claimed is:

1. An apparatus comprising:

a collapsible shade formed from a semitransparent material, the collapsible shade comprises:

a plurality of pleats including a first pleat and a second pleat; and a plurality of reinforced areas including a first reinforced area configured to couple the first pleat and the second pleat, the first reinforced area configured to maintain the first and second pleats either in an extended state or in a collapsed state; and a housing having a substantially cylindrical shape including a first end and a second end, the collapsible shade coupled to a first end of the housing, the housing including:

a light-emitting diode (LED) circuit coupled to the second end of the housing and including a LED;

at least one first gasket formed from rubber and positioned between the LED circuit and the housing to isolate the LED circuit from impacts and to provide an air gap between the housing the LED circuit;

a user-selectable button coupled to the housing;

a control circuit within the housing and coupled to the user-selectable button and to the LED circuit, the control circuit configured to control the LED to emit light having a selected wavelength and a selected brightness in response to selection of the user-selectable button; and at least one second gasket formed from rubber and positioned between the control circuit and the housing to isolate the control circuit from impacts.

2. The apparatus of claim 1, wherein the LED includes a multi-color LED configured to emit light having a wavelength selected from a plurality of wavelengths based on an electrical signal from the control circuit.

3. The apparatus of claim 1, wherein the control circuit is configured to control the LED to emit light according to a pre-determined pattern.

4. The apparatus of claim 3, wherein the pre-determined pattern comprises a Morse code.

5. The apparatus of claim 1, further comprising:

a solar panel including one or more photo-voltaic cells coupled to the second end of the housing;

a rechargeable battery within the housing; and a power management unit within the housing and coupled to the solar panel and the rechargeable battery, the power management unit configured to recharge the rechargeable battery using electricity from the solar panel.

6. The apparatus of claim 1, further comprising:

at least one post extending from a surface of the housing between the first end and the second end; and a handle configured to engage the at least one post.

7. The apparatus of claim 1, wherein the housing further comprises:

a recharge port configured to engage a connector to receive an electrical current; and an indicator light configured to emit light in response to receiving the electrical current at the recharge port.

8. The apparatus of claim 1, further comprising:

at least one opening extending through a sidewall of the housing and adjacent to the first end of the housing; and a heat sink coupled between the LED circuit and the housing such that air flow through the at least one opening passes between the housing and the heat sink.

9. An apparatus comprising:

a housing including:

a first end;

at least one sidewall extending substantially perpendicular to the first end to provide an open second end, the at least one sidewall and the first end cooperating to define an enclosure, the at least one sidewall including at least one opening adjacent to the open second end; and a housing cover configured to fit the open second end to seal the enclosure below a level of the at least one opening; and a button coupled to the housing and accessible to a user;

at least one first gasket coupled to the housing cover adjacent to the at least one opening;

a heat sink coupled to the at least one first gasket adjacent to the at least one opening to allow air flow between the heat sink and the housing cover;

a light-emitting diode (LED) circuit coupled to the heat sink and configured to emit light in response to a control signal;

a control circuit within the enclosure and coupled to the user-selectable button and to the LED circuit, the control circuit configured to provide the control signal to the LED; and at least one second gasket between the control circuit and the housing and formed from rubber to isolate the control circuit from impacts.

10. The apparatus of claim 9, wherein the LED circuit includes a multi-color LED configured to emit light having a selected wavelength in response to the control signal, the selected wavelength including red light, green light, and ultraviolet light.

11. The apparatus of claim 9, wherein the LED circuit includes an LED configured to emit light having a selected brightness level and according to a selected pattern in response to the control signal.

12. The apparatus of claim 9, wherein the housing further comprises:

a recharge port configured to engage a connector to receive an electrical current; and an indicator light configured to emit light in response to receiving the electrical current at the recharge port.

13. The apparatus of claim 9, further comprising:

a solar panel including one or more photo-voltaic cells coupled to the first end of the housing;

a rechargeable battery within the enclosure; and a power management unit within the enclosure, the power management unit coupled to the solar panel through the first end and the rechargeable battery and configured to recharge the rechargeable battery using electricity from the solar panel.

14. The apparatus of claim 9, further comprising:

at least one post extending from a surface of the housing between the first end and the second end; and a handle configured to engage the at least one post.

15. The apparatus of claim 9, further comprising:

a collapsible shade including a first open end configured to couple to the housing cover and including a second open end, the collapsible shade including:

a plurality of pleats including a first pleat and a second pleat;

a plurality of reinforced areas including a reinforced area configured to couple the first pleat and the second pleat; and wherein the plurality of reinforced areas secure the plurality of pleats in a selected state, the selected state including at least one of a collapsed state, an expanded state, or a partially expanded state.

16. An apparatus comprising:

a housing defining an enclosure;

a solar panel coupled to a first end of the housing;

a light emitting diode (LED) circuit coupled to a second end of the housing via at least one first fastener including a gasket, the LED circuit including a multi-color LED;

a collapsible shade including a first open end configured to couple to the housing around the LED circuit and including a second open end, the collapsible shade comprises:

a plurality of pleats including a first pleat and a second pleat; and a plurality of reinforced areas including a first reinforced area configured to couple the first pleat and the second pleat, the first reinforced area configured to maintain the first and second pleats either in an extended state or in a collapsed state;

a button coupled to the housing;

a control circuit within the enclosure and coupled to the button, the control circuit configured to selectively provide a control signal to the LED circuit in response to a button press event to control the LED to emit light according to selected brightness level of a plurality of brightness levels, according to a selected wavelength from a plurality of wavelengths, and according to a Morse code; and at least one second gasket between the control circuit and the housing to isolate the control circuit from impacts.

17. The apparatus of claim 16, wherein the housing further comprises:

a rechargeable battery within the enclosure;

a recharge port configured to engage a connector to receive an electrical current; and a power management circuit coupled to the battery, to the solar panel, and to the recharge port, the power management circuit configured to selectively deliver power from one of the solar panel and the recharge port to the battery.

18. The apparatus of claim 16, further comprising:

at least one opening extending through a sidewall of the housing; and a heat sink coupled between the LED circuit and the housing such that air flow through the at least one opening passes between the housing and the heat sink.

* * * * *